US009436104B2

(12) United States Patent
Azuma et al.

(10) Patent No.: US 9,436,104 B2
(45) Date of Patent: Sep. 6, 2016

(54) ELECTROPHOTOGRAPHIC PHOTOSENSITIVE MEMBER AND IMAGE FORMING APPARATUS

(71) Applicant: KYOCERA DOCUMENT SOLUTIONS INC., Osaka (JP)

(72) Inventors: Jun Azuma, Osaka (JP); Keiji Maruo, Osaka (JP); Kensuke Okawa, Osaka (JP); Akihiko Ogata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/288,614

(22) Filed: May 28, 2014

(65) Prior Publication Data

US 2014/0356773 A1 Dec. 4, 2014

(30) Foreign Application Priority Data

May 31, 2013 (JP) ..... 2013-115613

(51) Int. Cl.
*G03G 5/047* (2006.01)
*G03G 5/05* (2006.01)
*G03G 5/06* (2006.01)

(52) U.S. Cl.
CPC ..... *G03G 5/047* (2013.01); *G03G 5/0564* (2013.01); *G03G 5/0614* (2013.01); *G03G 5/0672* (2013.01)

(58) Field of Classification Search
CPC ..... G03G 5/0614; G03G 5/14756
See application file for complete search history.

(56) References Cited

U.S. PATENT DOCUMENTS

2007/0281227 A1* 12/2007 Maruo et al. ..... 430/58.05
2009/0047589 A1* 2/2009 Tajima et al. ..... 430/70

FOREIGN PATENT DOCUMENTS

JP 2006-008670 * 1/2006 ..... G03G 5/06
JP 2006-008670 A 1/2006
JP 2011-248251 A 12/2011

OTHER PUBLICATIONS

Diamond, "Handbook of Imaging Materials" Marcel Dekker, NY, NY 1991.*

Translation of JP 2006-008670 published Jan. 2006.*
An Office Action; "Notice of Reasons for Rejection," issued by the Japanese Patent Office on Jul. 14, 2015, which corresponds to Japanese Patent Application No. 2013-115613 and is related to U.S. Appl. No. 14/288,614.

* cited by examiner

*Primary Examiner* — Peter Vajda
(74) *Attorney, Agent, or Firm* — Studebaker & Brackett PC

(57) ABSTRACT

An electrophotographic photosensitive member includes a photosensitive layer. The photosensitive layer contains a charge generating material, a hole transport material, and a binder resin. The hole transport material contains an amine stilbene derivative represented by a general formula (1), and the binder resin contains a polycarbonate resin represented by a general formula (2).

(1)

(2)

6 Claims, 2 Drawing Sheets

ELECTROPHOTOGRAPHIC PHOTOSENSITIVE MEMBER AND IMAGE FORMING APPARATUS

INCORPORATION BY REFERENCE

The present application claims priority under 35 U.S.C. §119 to Japanese Patent Application No. 2013-115613, filed May 31, 2013. The contents of this application are incorporated herein by reference in their entirety.

BACKGROUND

The present disclosure relates to electrophotographic photosensitive members and also to image forming apparatuses provided with an electrophotographic photosensitive member.

Electrophotographic printers and multifunction peripherals include a photosensitive member used as an image bearing member. Examples of the photosensitive member include organic photosensitive members and inorganic photosensitive members (such as selenium photosensitive members and amorphous silicon photosensitive members). From among these photosensitive members, organic photosensitive members have little effect on the environment as well as being easy to form into a film and easy to manufacture, as compared with inorganic photosensitive members. Therefore, organic photosensitive members are currently used as the image bearing members in many image forming apparatuses.

Typically, an organic photosensitive member includes a conductive substrate and a photosensitive layer. The photosensitive layer is disposed directly or indirectly on the conductive substrate. The photosensitive layer mainly contains a charge transport material, a charge generating material, and a resin. The resin binds the charge transport material and the charge generating material. Some organic electrophotographic photosensitive members contain the charge transport material and the charge generating material in different layers, and such an organic photosensitive member is referred to as a multi-layer electrophotographic photosensitive member. Some organic electrophotographic photosensitive members contain the charge transport material and the charge generating material in one and the same layer, and such an organic electrophotographic photosensitive member is referred to as a single-layer electrophotographic photosensitive member.

SUMMARY

An electrophotographic photosensitive member according to the present disclosure includes a photosensitive layer. The photosensitive layer is a single-layer photosensitive layer that contains a charge generating material, a hole transport material, and a binder resin. Alternatively, the photosensitive layer is a multi-layer photosensitive layer in which a charge generating layer containing the charge generating material and a charge transport layer containing the hole transport material and the binder resin are stacked. In the electrophotographic photosensitive member according to the present disclosure, the hole transport material contains an amine stilbene derivative represented by a general formula (1). The binder resin contains a polycarbonate resin represented by a general formula (2).

(1)

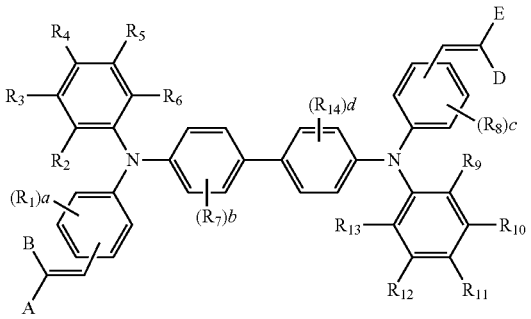

In the general formula (1), $R_1$ to $R_{14}$ each independently represent a hydrogen atom, a halogen atom, an alkyl group having 1 to 20 carbon atoms, a halogenated alkyl group having 1 to 20 carbon atoms, an alkoxy group having 1 to 20 carbon atoms, an aryl group having 6 to 20 carbon atoms substituted with a methyl group, an unsubstituted aryl group having 6 to 20 carbon atoms, an amino group substituted with a methyl group, or an unsubstituted amino group. The numbers a to d each independently represent an integer of 0 or more and 4 or less. At least either A or B is an aryl group having 6 to 20 carbon atoms substituted with a methyl group or an unsubstituted aryl group having 6 to 20 carbon atoms. At least D or E is an aryl group having 6 to 20 carbon atoms substituted with a methyl group or an unsubstituted aryl group having 6 to 20 carbon atoms. Each of A, B, D, and E that is not an aryl group is a hydrogen atom.

(2)

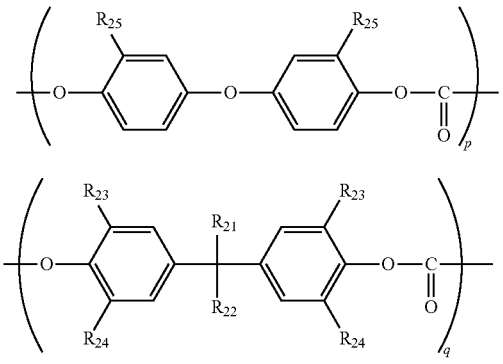

In the general formula (2), $R_{21}$ and $R_{22}$ each represent a hydrogen atom, an alkyl group having 1 to 8 carbon atoms, or a phenyl group. Alternatively, $R_{21}$ and $R_{22}$ are bonded together to form a cycloalkylidene group having 5 to 8 carbon atoms. $R_{23}$ to $R_{25}$ each independently represent a hydrogen atom or an alkyl group having 1 to 4 carbon atoms. In addition, $p+q=1$ and $p \geq 0.4$ are both satisfied.

An image forming apparatus according to the present disclosure includes an image bearing member, a charger, an exposure, a developer, and a transfer unit. The charger charges a surface of the image bearing member. The exposure exposes the surface of the image bearing member charged by the charger to light so as to form an electrostatic latent image on the surface. The developer develops the electrostatic latent image into a toner image. The transfer unit transfers the toner image from the image bearing member to a transfer target. The image bearing member included in the image forming apparatus according to the present embodiment is the electrophotographic photosensitive member described above.

DETAILED DESCRIPTION

Figure 1A:
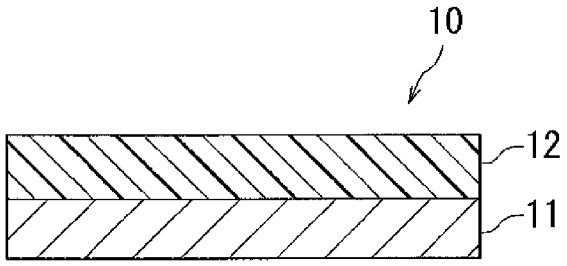
FIG. 1A is a schematic cross sectional view showing a structure of a single-layer electrophotographic photosensitive member according to an embodiment of the present disclosure.

The following describes an embodiment of the present disclosure. However, the present disclosure is not limited to the specific embodiment.

An electrophotographic photosensitive member (which may be referred to simply as a "photosensitive member") according to the present embodiment includes a photosensitive layer. The photosensitive layer is either: a single-layer photosensitive layer that contains a charge generating material, a hole transport material, and a binder resin; or a multi-layer photosensitive layer in which a charge generating layer containing a charge generating material and a charge transport layer containing a charge transport material and a binder resin are stacked. In other words, the electrophotographic photosensitive member according to the present embodiment can be either of a single-layer electrophotographic photosensitive member or a multi-layer electrophotographic photosensitive member.

The hole transport material is a type of a charge transport material and contains the amine stilbene derivative represented by a general formula (1).

(1)

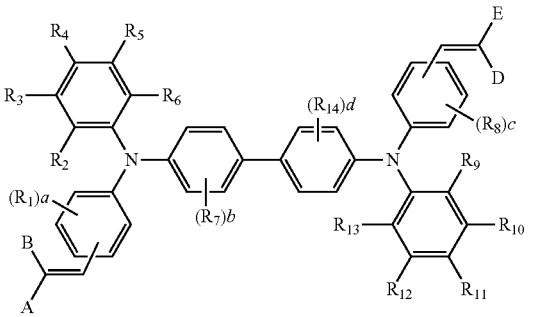

In the general formula (1), $R_1$ to $R_{14}$ each independently represent a hydrogen atom, a halogen atom, an alkyl group having 1 to 20 carbon atoms, a halogenated alkyl group having 1 to 20 carbon atoms, an alkoxy group having 1 to 20 carbon atoms, an aryl group having 6 to 20 carbon atoms substituted with a methyl group, an unsubstituted aryl group having 6 to 20 carbon atoms, an amino group substituted with a methyl group, or an unsubstituted amino group. The numbers a to d each independently represent an integer of 0 or more and 4 or less. At least either A or B is an aryl group having 6 to 20 carbon atoms substituted with a methyl group, or an unsubstituted aryl group having 6 to 20 carbon atoms. At least either D or E is an aryl group having 6 to 20 carbon atoms substituted with a methyl group or an unsubstituted aryl group having 6 to 20 carbon atoms. In addition, each of A, B, D, and E that is not an aryl group is a hydrogen atom.

The binder resin contains a polycarbonate resin represented by a general formula (2).

(2)

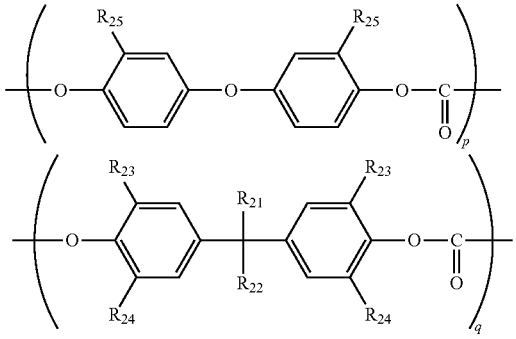

In the general formula (2), $R_{21}$ and $R_{22}$ each represent a hydrogen atom, an alkyl group having 1 to 8 carbon atoms, or a phenyl group. Alternatively, $R_{21}$ and $R_{22}$ are bonded together to form a cycloalkylidene group having 5 to 8 carbon atoms. $R_{23}$ to $R_{25}$ each independently represent a hydrogen atom or an alkyl group having 1 to 4 carbon atoms. In addition, $p+q=1$ and $p \geq 0.4$ are both satisfied.

The electrophotographic photosensitive member according to the present embodiment contains the amine stilbene derivative represented by the general formula (1) and the polycarbonate resin represented by the general formula (2) and thus has excellent electrical characteristics and excellent abrasion resistance. Therefore, an image forming apparatus that includes such an electrophotographic photosensitive member has excellent durability and remains capable of forming high-quality images for a long time.

The electrophotographic photosensitive member according to the present embodiment is not particularly limited as long as the above limitations are satisfied. More specifically, the limitations to be satisfied are that the photosensitive layer contains the amine stilbene derivative represented by the general formula (1) as the hole transport material and also contains the polycarbonate resin represented by the general formula (2) as the binder resin.

Figure 1B:
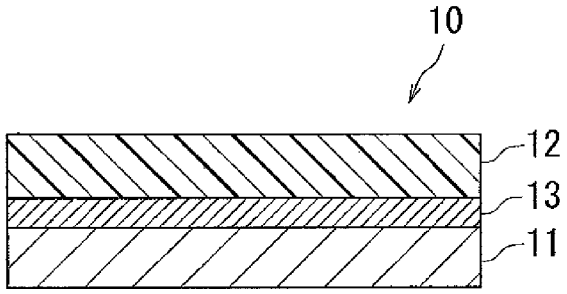
FIG. 1B is a schematic cross sectional view showing another structure of the single-layer electrophotographic photosensitive member according to the embodiment of the present disclosure.

More specifically, the photosensitive member according to the present embodiment may be a so-called single-layer electrophotographic photosensitive member as shown in FIG. 1A or 1B, for example. The photosensitive layer included in a single-layer electrophotographic photosensitive member at least contains, all in this layer, a charge generating material, a hole transport material, and a resin called a binder.

Figure 2A:
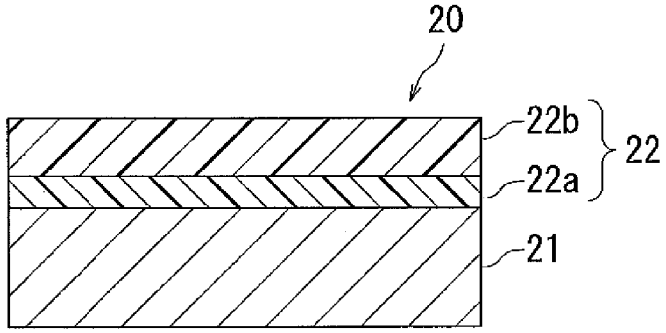
FIG. 2A is a schematic cross sectional view showing a structure of a multi-layer electrophotographic photosensitive member according to the embodiment of the present disclosure.
Figure 2B:
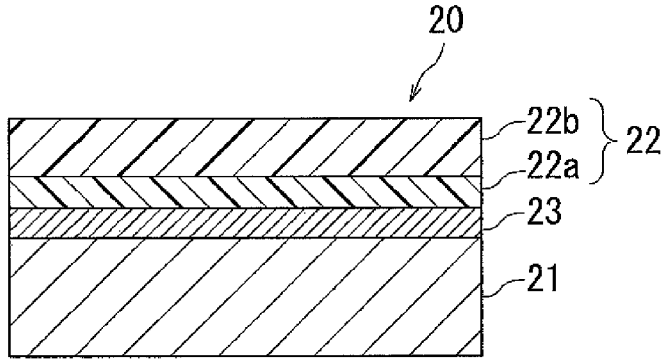
FIG. 2B is a schematic cross sectional view showing another structure of the multi-layer electrophotographic photosensitive member according to the embodiment of the present disclosure.

Alternatively, the photosensitive member may be a so-called multi-layer electrophotographic photosensitive member shown in FIG. 2A or 2B. The photosensitive layer included in a multi-layer electrophotographic photosensitive member has a multi-layered structure in which at least a charge generating layer and a charge transport layer are stacked. The charge generating layer at least contains a charge generating material and a rein called a base resin. The charge transport layer contains a hole transport material and a binder resin, which is similar to the resin contained in the single-layer electrophotographic photosensitive members described above.

In the photosensitive member (either the single-layer electrophotographic photosensitive member or the multi-layer electrophotographic photosensitive member) according to the present embodiment, the binder resin described above contains the polycarbonate resin represented by the general formula (2).

FIGS. 1A and 1B are each a schematic cross sectional view showing a structure of a single-layer electrophotographic photosensitive member 10 according to the embodiment of the present disclosure.

As shown in FIG. 1A, the single-layer electrophotographic photosensitive member 10 includes a conductive substrate 11 and a single-layer photosensitive layer 12. The single-layer photosensitive layer 12 is disposed on the conductive substrate 11. The single-layer photosensitive layer 12 contains a charge generating material, a hole transport material, an electron transport material, and a binder resin all within this layer.

The single-layer electrophotographic photosensitive member 10 is not particularly limited as long as the conductive substrate 11 and the single-layer photosensitive layer 12 are included. More specifically, for example, the photosensitive layer 12 may be disposed directly on the conductive substrate 11 as shown in FIG. 1A. Alternatively, an undercoat layer 13 may be disposed between the conductive substrate 11 and the single-layer photosensitive layer 12 as shown in FIG. 1B.

FIGS. 2A and 2B are each a schematic cross sectional view showing a structure of a multi-layer electrophotographic photosensitive member 20 according to the embodiment of the present disclosure.

As shown in FIG. 2A, the multi-layer electrophotographic photosensitive member 20 includes a conductive substrate 21 and a multi-layer photosensitive layer 22. The multi-layer photosensitive layer 22 is disposed on the conductive substrate 21. The multi-layer photosensitive layer 22 includes a charge generating layer 22*a* and a charge transport layer 22*b*. The charge generating layer 22*a* contains a charge generating material and a base resin. The charge transport layer 22*b* contains a hole transport material and a binder resin.

The multi-layer electrophotographic photosensitive member 20 is not particularly limited as long as the conductive substrate 21 and the multi-layer photosensitive layer 22 are included and the multi-layer photosensitive layer 22 has a structure in which the charge generating layer 22*a* and the charge transport layer 22*b* are stacked. More specifically, the multi-layer electrophotographic photosensitive member 20 may include the charge generating layer 22*a* and the charge transport layer 22*b* stacked on the conductive substrate 21 in the stated order, as shown in FIG. 2A. Alternatively, the multi-layer electrophotographic photosensitive member 20 may include the charge transport layer 22*b* and the charge generating layer 22*a* stacked on the conductive substrate 21 in the stated order, although such a multi-layer electrophotographic photosensitive member is not shown in the figures.

In addition, the photosensitive layer 22 may be disposed directly on the conductive substrate 21. Alternatively, as shown in FIG. 2B, an undercoat layer 23 may be disposed between the conductive substrate 21 and the multi-layer photosensitive layer 22. Alternatively, the multi-layer electrophotographic photosensitive member 20 may include an intermediate layer between the charge transport layer 22*b* and the charge generating layer 22*a*, although such a multi-layer electrophotographic photosensitive member is not shown in the figures.

The single- or multi-layer electrophotographic photosensitive member according to the present embodiment may further include a protective layer on or above the surface of the photosensitive layer (the single- or multi-layer photosensitive layer). Yet, in order to prevent image deletion from occurring and to reduce manufacturing cost, the photosensitive layer is preferably disposed as the outermost layer of the single- or multi-layer electrophotographic photosensitive member according to the present embodiment.

The following describes in detail the respective portions of the single- and multi-layered electrophotographic photosensitive members.

[Conductive Substrate]

The conductive substrate according to the present embodiment is not particularly limited as long as at least a surface portion of the conductive substrate has conductivity. The conductive substrate may be made from a conductive material, for example. Alternatively, the conductive substrate may be made from a plastic material or glass having a surface coated or deposited with a conductive material. Examples of the conductive material include metals, such as aluminum, iron, copper, tin, platinum, silver, vanadium, molybdenum, chromium, cadmium, titanium, nickel, palladium, indium, stainless steel, and brass as well as an alloy of such metals. These conductive materials may be used alone, or two or more of the conductive materials may be used in combination. From among the conductive substrates listed above as examples, a conductive substrate made from aluminum or an aluminum alloy is preferred. The use of such a conductive substrate can ensure to provide a photosensitive member capable of forming more appropriate images. It is assumed to be because the charge mobility from the photosensitive layer to the conductive substrate is high.

The shape of the conductive substrate is not particularly limited. For example, the conductive substrate may take the form of a sheet or drum depending on the structure of the image forming apparatus to which the conductive substrate is applied.

In addition, the conductive substrate desirably has a sufficient mechanical strength in use.

[Photosensitive Layer]

The single-layer electrophotographic photosensitive member 10 includes the single-layer photosensitive layer 12. The single-layer photosensitive layer 12 contains the charge generating material, the hole transport material, and the binder resin all within this layer. Further, the multi-layer photosensitive layer 22 of the multi-layer electrophotographic photosensitive member 20 includes the charge generating layer 22*a* and the charge transport layer 22*b*. The charge generating layer 22*a* contains the charge generating material. The charge transport layer 22*b* contains the hole transport material and the binder resin.

The photosensitive layer may additionally contain, as needed, an electron transport material or one or more additives, regardless of whether the photosensitive member is a single- or multi-layer electrophotographic photosensitive member.

(Charge Generating Material)

The charge generating material is not particularly limited as long as it is usable as the charge generating material for an electrophotographic photosensitive member. Examples of the charge generating material include: X-form metal-free phthalocyanine (x-$H_2$Pc); Y-form titanyl phthalocyanine (Y-TiOPc); perylene pigments; bis-azo pigments; dithioketopyrrolopyrrole pigments; metal-free naphthalocyanine pigments; metal naphthalocyanine pigments; squaraine pigments; tris-azo pigments; indigo pigments; azulenium pigments; cyanine pigments; powders of inorganic photoconductive materials, such as selenium, selenium-tellurium, selenium-arsenic, cadmium sulfide, and amorphous silicon; pyrylium salts; anthanthrone based pigments; triphenylmethane based pigments; threne based pigments; toluidine based pigments; pyrazoline based pigments; and quinacridone based pigments.

In order to have an absorption wavelength within a desired range, one of the charge generating materials listed above may be used alone, or two or more of the charge generating materials may be used in combination. As for image forming apparatuses employing, for example, a digital optical system (for example, laser beam printers and facsimile machines each employing a semiconductor laser or the like as the light source), a photosensitive member having a sensitivity in a wavelength range of 700 nm or longer is preferred. For that reason, it is preferable to use a phthalocyanine based pigment (for example, X-form metal-free phthalocyanine (x-$H_2$Pc) or Y-form titanyl phthalocyanine (Y-TiOPc)). Note that the crystal form of the phthalocyanine based pigment is not particularly limited, and various crystal forms can be used.

As for image forming apparatuses employing a short-wavelength laser light source (for example, a laser light source having wavelengths within a range of 350 nm to 550 nm or so), it is preferable to use an anthanthrone based pigment or a perylene based pigment as the charge generating material.

Specifically, from among the charge generating materials listed above, it is more preferable to use the phthalocyanine based pigments (CGM-1 to CGM-4) represented by the chemical formulas (3) to (6) below.

CGM-1

(3)

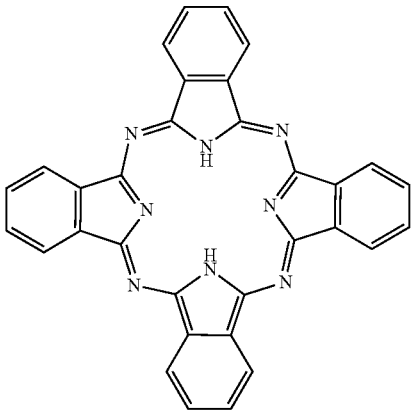

-continued

CGM-2

(4)

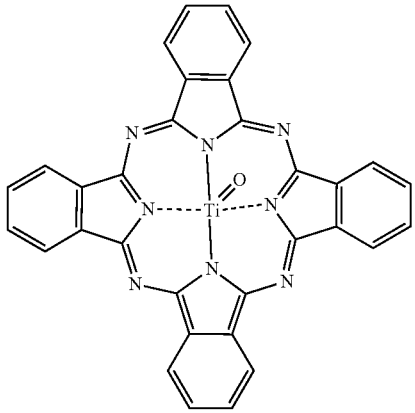

CGM-3

(5)

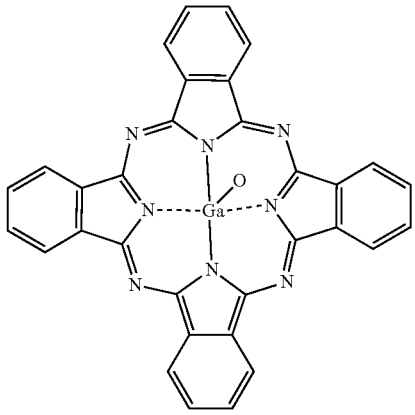

CGM-4

(6)

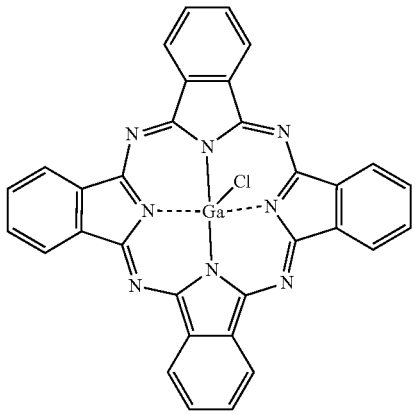

(Hole Transport Material)

The hole transport material contains the amine stilbene derivative represented by the general formula (1).

(1)

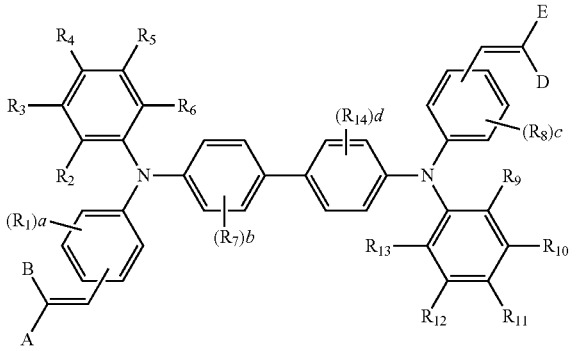

In the general formula (1), $R_1$ to $R_{14}$ each independently represent a hydrogen atom, a halogen atom, an alkyl group having 1 to 20 carbon atoms, a halogenated alkyl group having 1 to 20 carbon atoms, an alkoxy group having 1 to 20 carbon atoms, an aryl group having 6 to 20 carbon atoms substituted with a methyl group, an unsubstituted aryl group having 6 to 20 carbon atoms, an amino group substituted with a methyl group, or an unsubstituted amino group. The numbers a to d each independently represent an integer of 0 or more and 4 or less. At least either A or B is an aryl group having 6 to 20 carbon atoms substituted with a methyl group or an unsubstituted aryl group having 6 to 20 carbon atoms. At least either D or E is an aryl group having 6 to 20 carbon atoms substituted with a methyl group or an unsubstituted aryl group having 6 to 20 carbon atoms. In addition, each of A, B, D, and E that is not an aryl group is a hydrogen atom.

In the amine stilbene derivative represented by the general formula (1), steric hindrance occurs by introducing a predetermined ethenyl group or a predetermined substituent at the ortho, meta or para position of the phenyl in a phenylamino group at a molecular end. The amine stilbene derivatives such as above are less prone to crystallization, and thus the compatibility with the binder resin and the solubility in a solvent can be improved.

Therefore, by using the amine stilbene derivative represented by the general formula (1) as the hole transport material in the electrophotographic photosensitive member, the amine stilbene derivative can be uniformly dispersed within the photosensitive layer. Consequently, the resulting electrophotographic photosensitive member to be provided will have excellent sensitivity characteristics and durability.

From among the amine stilbene derivatives represented by the general formula (1), the amine stilbene derivative having a predetermined ethenyl group at each of the ortho and meta positions of the phenyl in a phenylamino group at a molecular end is advantageous in that such amine stilbene derivatives can be manufactured more easily through reaction with a substance, such as an iodobenzene derivative.

The hole transport material according to the present disclosure may contain the amine stilbene derivative represented by a general formula (1'). This can ensure that the resulting electrophotographic photosensitive member to be provided will have excellent sensitivity characteristics and durability.

(1')

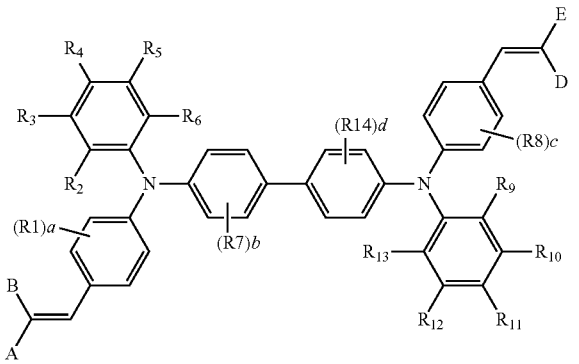

In the general formula (1'), A, B, D, E, $R_1$ to $R_{14}$, and the numbers a to d are the same as those in the general formula (1).

That is, in the amine stilbene derivative represented by the general formula (1'), steric hindrance is caused by introducing a predetermined ethenyl group or a predetermined substituent at the para position of the phenyl in a phenylamino group at a molecular end. Therefore, the compatibility of the amine stilbene derivative with the binder resin and the solubility of the amine stilbene derivative to the solvent can be improved.

From among the amine stilbene derivative represented by the general formula (1'), a derivative having a predetermined ethenyl group at the para position of the phenyl in a phenylamino group at a molecular end is advantageous in that such a derivative can be manufactured more easily through a formylation reaction, for example.

More preferably, the amine stilbene derivatives used in the present disclosure satisfy that $R_2$, $R_6$, $R_9$, and $R_{13}$ in the general formulas (1) and (1') each represent a substituted alkyl group having 1 to 10 carbon atoms or an unsubstituted alkyl group having 1 to 10 carbon atoms. This can further improve the compatibility of the amine stilbene derivative with the binder resin and the solubility of the amine stilbene derivative to the solvent. As a consequence, the charge mobility can be improved in addition to more effectively preventing crystallization in the binder resin.

Therefore, the use of the amine stilbene derivative having such a substituent as the charge transport material (hole transport material) of an electrophotographic photosensitive member can ensure the resulting electrophotographic photosensitive member to have a more excellent sensitivity characteristics and durability. In addition, introduction of such a substituent is relatively easy, so that the predetermined amine stilbene derivatives can be manufactured at relatively high yield.

Further, the amine stilbene derivatives according to the present disclosure satisfy that at least either A or B in the general formulas (1) and (1') is an aryl group having 6 to 20 carbon atoms substituted with a methyl group or an unsubstituted aryl group having 6 to 20 carbon atoms. It is also satisfied that at least either D or E is an aryl group having 6 to 20 carbon atoms substituted with a methyl group or an unsubstituted aryl group having 6 to 20 carbon atoms. In addition, each of A, B, D, and E that is not an aryl group is a hydrogen atom. Owing to the above structure, the amine stilbene derivatives used in the present embodiment can undergo intramolecular conjugate to a greater extent to improve the charge mobility.

Therefore, with the use of the amine stilbene derivative as the hole transport material in an electrophotographic photosensitive member, the resulting electrophotographic photosensitive member to be provided will have excellent sensitivity characteristics. In addition, introduction of substituents to the amine stilbene derivative having such a structure is relatively easy. Therefore, the predetermined amine stilbene derivatives can be manufactured at relatively high yield.

More specifically, as the amine stilbene derivative represented by the general formula (1) given above, it is preferable to use HTM-1 to HTM-6 represented by the chemical formulas (7) to (12), respectively.

HTM-1

(7)

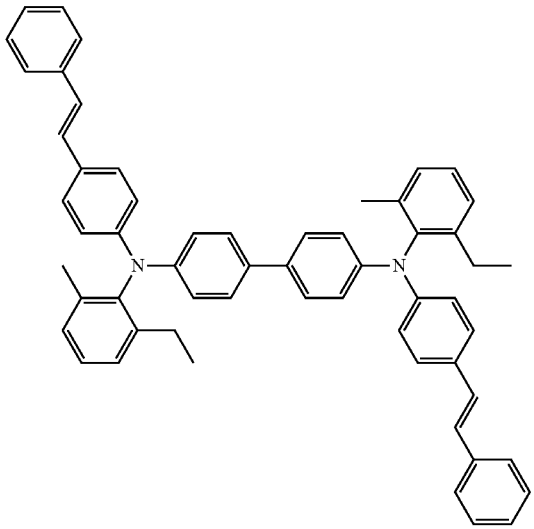

HTM-2

(8)

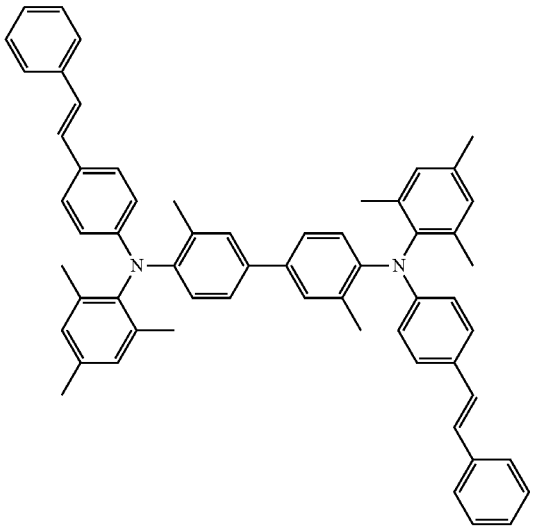

HTM-3

(9)

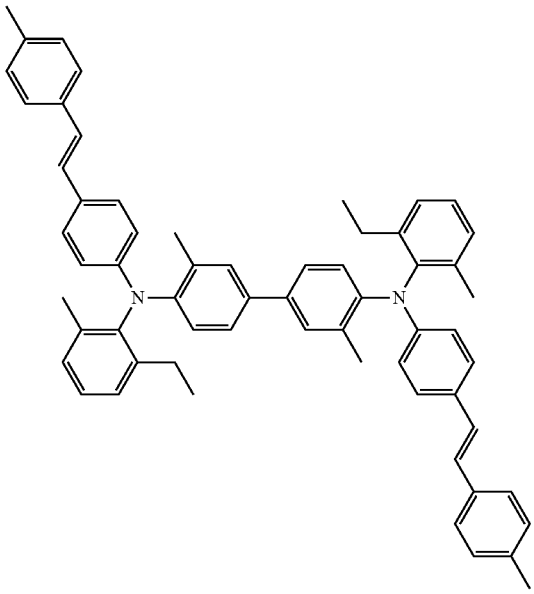

HTM-4

(10)

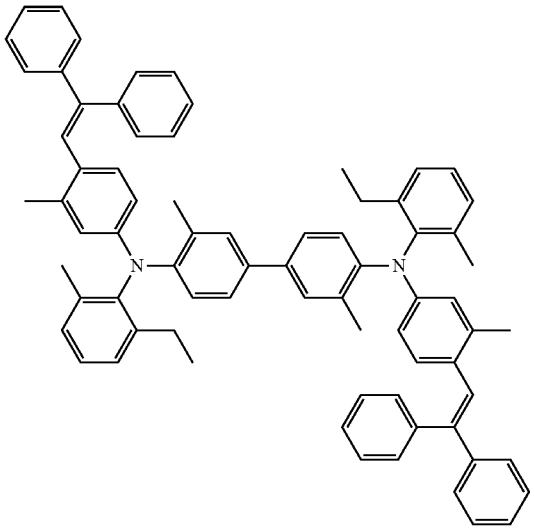

-continued

HTM-5

(11)

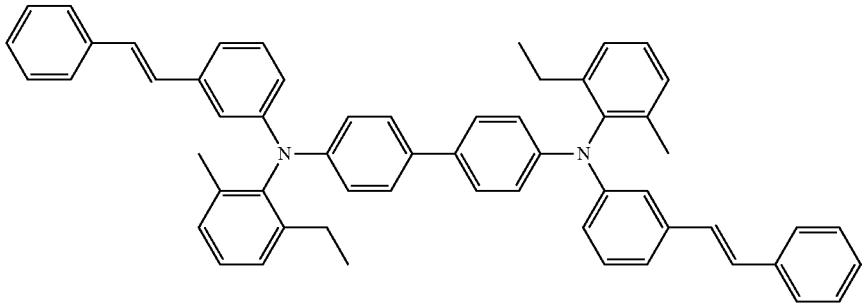

HTM-6

(12)

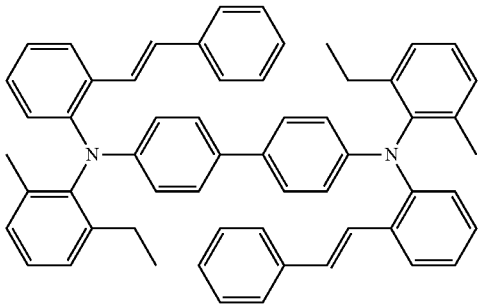

(Electron Transport Material)

The photosensitive layer may contain an electron transport material as the charge transport material as needed, in addition to the hole transport material. The presence of an electron transport material is preferred especially in a single-layer electrophotographic photosensitive member in order to impart bipolar characteristics. On the other hand, in a multi-layer electrophotographic photosensitive member, the charge generating layer may contain an electron transport material. Examples of the electron transport material include quinone based compounds (such as, naphthoquinone based compounds, diphenoquinone based compounds, anthraquinone based compounds, azoquinone based compounds, nitroanthraquinone based compounds, and dinitroanthraquinone based compounds), malononitrile based compounds, thiopyran based compounds, trinitrothioxanthone based compounds, 3,4,5,7-tetranitro-9-fluorenone based compounds, dinitroanthracene based compounds, dinitroacridine based compounds, tetracyanoethylene, 2,4,8-trinitrothioxanthone, dinitrobenzene, dinitroanthracene, dinitroacridine, succinic anhydride, maleic anhydride, and dibromomaleic anhydride. One of these electron transport materials may be used alone, or two or more of the electron transport materials may be used in combination.

Specific examples of the electron transport materials listed above are ETM-1 to ETM-8 represented by the chemical formulas (13) to (20), respectively.

ETM-1

(13)

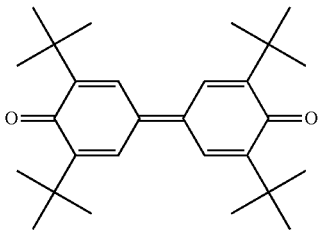

ETM-2

(14)

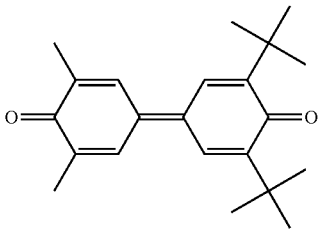

-continued

ETM-3

(15)

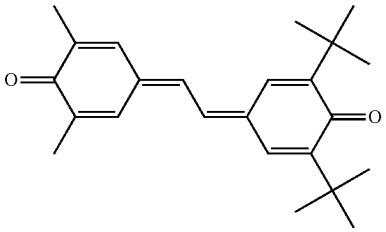

ETM-4

(16)

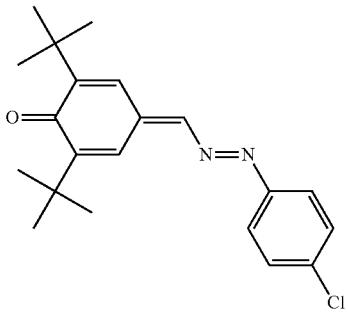

ETM-5

(17)

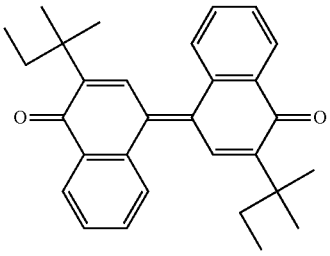

ETM-6

(18)

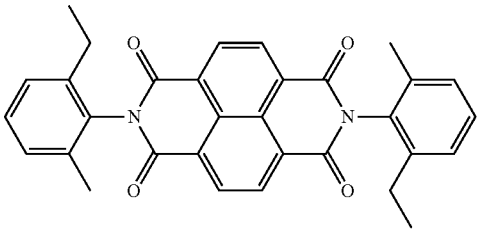

ETM-7

(19)

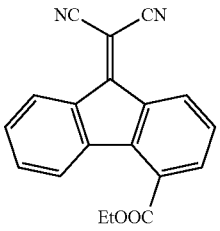

-continued

ETM-8

(20)

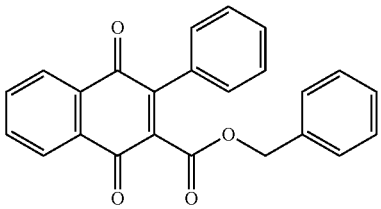

(Resin)

Examples of the resin used in the photosensitive member include a binder resin and a base resin that is used for the charge generating layer (charge-generating-layer base resin). As described above, the binder resin is used for the single-layer photosensitive layer included in a single-layer electrophotographic photosensitive member or for the charge transport layer included in a multi-layer electrophotographic photosensitive member. The charge-generating-layer base resin is used for the charge generating layer included in a multi-layer electrophotographic photosensitive member.

As described above, the binder resin is used for the single-layer photosensitive layer included in a single-layer electrophotographic photosensitive member or for the charge transport layer included in a multi-layer electrophotographic photosensitive member. The binder resin contains the polycarbonate resin represented by the general formula (2).

The charge-generating-layer base resin is not particularly limited as long as it is usable for the charge generating layer of a multi-layer electrophotographic photosensitive member as described above.

Typically, in a multi-layer electrophotographic photosensitive member, the charge generating layer and the charge transport layer are formed in the stated order. Therefore, within one and the same multi-layer electrophotographic photosensitive member, a base resin that is different from the binder resin is selected as the charge-generating-layer base resin in order to avoid the base resin from dissolving into an application liquid for a charge transport layer.

Specific examples of the charge-generating-layer base resin include styrene-butadiene copolymers, styrene-acrylonitrile copolymers, styrene-maleic acid copolymers, acrylic copolymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, polyurethane resins, polysulfone resins, diallyl phthalate resins, ketone resins, polyvinyl acetal resins, polyvinyl butyral resins, polyether resins, silicone resins, epoxy resins, phenol resins, urea resins, melamine resins, epoxy acrylate resins, and urethane-acrylate resin. Of these charge-generating-layer base resins, it is preferable to use polyvinyl butyral. For the charge generating layer, one of these charge-generating-layer base resins may be used alone, or two or more of the charge-generating-layer base resins may be used in combination.

(Binder Resin)

The binder resin contains the polycarbonate resin represented by the general formula (2). The polycarbonate resin represented by the general formula (2) is a polycarbonate copolymer made of the constitutional repeating units represented by the general formulas (2-1) and (2-2).

(2)

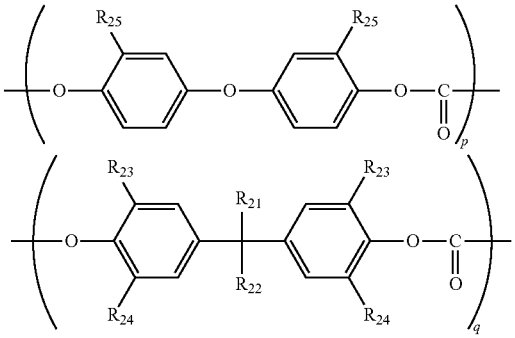

In the general formula (2), $R_{21}$ and $R_{22}$ each represent a hydrogen atom, an alkyl group having 1 to 8 carbon atoms, or a phenyl group. Alternatively, $R_{21}$ and $R_{22}$ are bonded together to form a cycloalkylidene group having 5 to 8 carbon atoms. $R_{23}$ to $R_{25}$ each independently represent a hydrogen atom or an alkyl group having 1 to 4 carbon atoms. In addition, p+q=1 and p≥0.4 are both satisfied.

(2-1)

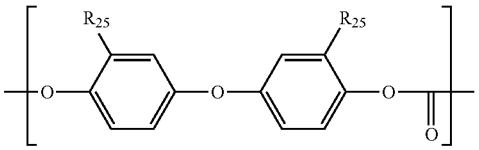

(2-2)

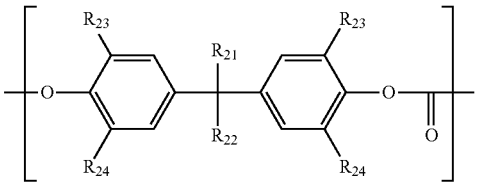

When the polycarbonate resin represented by the general formula (2) is used as the binder resin, the abrasion resistance of the resulting photosensitive member is improved on condition that the value of p is 0.4 or more. In addition, in view of the other characteristics (such as the electrical characteristics, or the mechanical characteristics) of the electrophotographic photosensitive member, the value of p is more preferably 0.5 or more and 0.7 or less.

In the constitutional repeating unit represented by the general formula (2-2), $R_{21}$ and $R_{22}$ each preferably represent a hydrogen atom, an alkyl group having 1 to 8 carbon atoms, or a phenyl group. Alternatively, $R_{21}$ and $R_{22}$ are bonded together to form a cycloalkylidene group having 5 to 8 carbon atoms. More preferably, $R_{21}$ is an ethyl group and $R_{22}$ is a methyl group.

The constitutional repeating unit represented by the general formula (2-2) contains an appropriately substituted quaternary carbon between the two phenylene groups. That is to say, the constitutional repeating unit itself has a relatively low polarity portion. This facilitates gathering of the hole transport material represented by the general formula (1) in the vicinity of the constitutional repeating unit represented by the general formula (2-2). As a result, the dispersibility of the hole transport material in the charge transport layer is improved to ensure that the resulting photosensitive member achieves stable photosensitivity.

In contrast, for example, when $R_{21}$ and $R_{22}$ are bonded together to form a cycloalkylidene group having 5 to 8 carbon atoms, the constitutional repeating unit represented by the general formula (2-2) is rather bulky. This leads to that the dispersibility of the polycarbonate resin is improved but the abrasion resistance tends to be lower. Therefore, the value of q in the general formula (2) needs to be 0.6 or less and preferably 0.5 or less.

In addition, in the respective constitutional repeating units represented by the general formulas (2-1) and (2-2), $R_{23}$ to $R_{25}$ each independently represent a hydrogen atom or an alkyl group having 1 to 4 carbon atoms. Preferably, one of $R_{23}$ to $R_{25}$ is a methyl group for the following reason.

That is, substitution of $R_{23}$ to $R_{25}$ each with an alkyl group can improve the solubility of the polycarbonate resin in a non-halogenated solvent and the compatibility of the polycarbonate resin with the amine stilbene derivative. Consequently, the resulting electrophotographic photosensitive member will have excellent electrical characteristics and abrasion resistance.

In contrast, as the chain length, branching, and number of alkyl substituents in the polycarbonate resin increase, the entanglement between the molecules tends to be reduced and thus the packing property of molecules tends to be reduced. Thus, an electrophotographic photosensitive member containing such a polycarbonate resin may be inferior in abrasion resistance.

Therefore, by substituting with an appropriate number of alkyl groups having an appropriate chain length in view of the aromatic ring of the constitutional repeating unit, the resulting polycarbonate resin described above can give excellent electrical characteristics and abrasion resistance to the resulting photosensitive member.

By the combined use of the hole transport material containing the amine stilbene derivative represented by the general formula (1) described above and the binder resin containing the polycarbonate represented by the general formula (2), their excellent characteristics can both be maintained. In addition, the amine stilbene derivative will have excellent compatibility with the polycarbonate resin represented by the general formula (2). Therefore, the abrasion resistance of the charge transport layer or the single-layer photosensitive layer can be improved while maintaining its excellent electrical characteristics.

The molecular weight of the binder resin (containing the polycarbonate resin represented by the general formula (2)) is preferably 30,000 or more in terms of the viscosity average molecular weight, and more preferably 40,000 or more and 60,000 or less. When the molecular weight of the binder resin is too low, the abrasion resistance of the binder resin cannot be sufficiently high, which may lead to the tendency that the charge transport layer or the single-layer photosensitive layer is more prone to abrasion. When the molecular weight of the binder resin is too high, on the other hand, the binder resin is less solvable in a non-halogenated polar solvent or in a non-polar mixed solvent, which may lead to the difficulty in preparing an application liquid for the charge transport layer or an application liquid for the single-layer photosensitive layer. Naturally, forming an appropriate charge transport layer or single-layer photosensitive layer tends to be difficult.

In terms of the structure, the polycarbonate resin may be, for example, a random copolymer in which constitutional repeating units represented by the general formulas (2-1) and (2-2) are arranged in a random sequence. In another example, the polycarbonate resin may be an alternating copolymer in which these constitutional repeating units are arranged in alternating sequence. In a yet another example, the polycarbonate resin may be a periodic copolymer in which one or more constitutional repeating units each represented by the general formula (2-1) and one or more constitutional repeating units each represented by the general formula (2-2) are arranged in a periodic sequence. In a yet another example, the polycarbonate resin may be a block copolymer in which a block of a plurality of constitutional repeating units each represented by the general formula (2-1) and a block of a plurality of constitutional repeating units each represented by the general formula (2-2) are arranged.

A method for manufacturing the polycarbonate resin represented by the general formula (2) is not particularly limited as long as the polycarbonate resin having the structure described above can be manufactured. Examples of the manufacturing method include a method which involves interfacial polycondensation between phosgene and a diol compound which forms a constitutional repeating unit of the polycarbonate resin (a so-called phosgene method) and a method involving ester exchange reaction of a diol compound with diphenyl carbonate. More specific examples include a method involving interfacial polycondensation between phosgene and a mixture obtained by mixing a diol compound represented by a general formula (2-3) and a diol compound represented by a general formula (2-4), such that the content of the diol compound represented by the general formula (2-3) is at least 40% by mol.

(2-3)

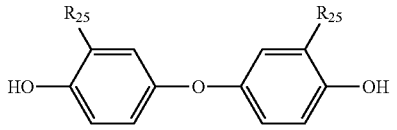

(2-4)

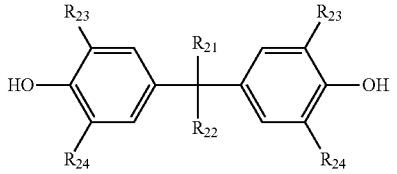

Note that the polycarbonate resin may be used alone as the binder resin according to the present embodiment. Alternatively, however, one or more resins other than the polycarbonate resin may be contained within a range not impairing the effect of the present disclosure. Examples of such other resins that may be contained in addition to the polycarbonate resin include thermoplastic resins (such as styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomer, vinyl chloride-vinyl acetate copolymers, polyester resins, alkyd resins, polyamide resins, polyurethane resins, polyarylate resins, polysulfone resins, diallyl phthalate resins, ketone resins, polyvinyl butyral resins, and polyether resins), thermosetting resins (such as silicone resins, epoxy resins, phenol resins, urea resins, melamine resins and other crosslinkable thermosetting resins), and photocurable resins (such as epoxy acrylate resins, and urethane-acrylate copolymer resins). These resins may be used alone, or two or more of these resins may be used in combination.

(Additives)

Any of the charge generating layer, the charge transport layer, the intermediate layer, and the protective layer included in the electrophotographic photosensitive member according to the present embodiment may additionally contain one or more additives within a range not adversely affecting the electrophotographic characteristics. Examples of the additives include antidegradants (such as antioxidant, radical scavenger, singlet quencher, ultraviolet absorbing agent, and the like), softeners, plasticizers, surface modifiers, fillers, thickeners, dispersion stabilizers, waxes, acceptors, donors, surfactants, and leveling agents. Examples of antioxidants include hindered phenol, hindered amine, paraphenylenediamine, arylalkane, hydroquinone, spirochromane, spiroindanone, and their derivatives as well as organosulfur compounds, and organophosphorous compounds.

In addition, in order to improve the sensitivity of the charge generating layer, the charge generating layer may contain a sensitizer (such as terphenyl, halonaphthoquinones, or acenaphthylene).

In addition, in order to improve the crack resistance of the charge transport layer, the charge transport layer may contain, as a plasticizer, one of the biphenyl derivatives represented by the chemical formulas BP-1 to BP-20 alone or two or more of the biphenyl derivatives in combination, for example.

(BP-1)

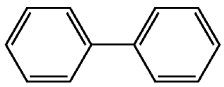

(BP-2)

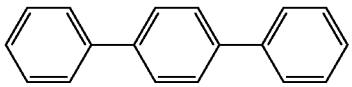

(BP-3)

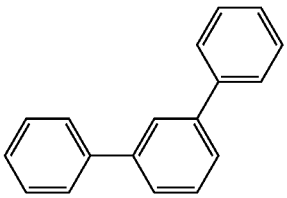

(BP-4)

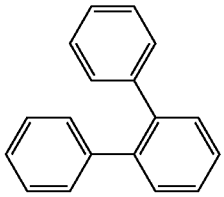

(BP-5)

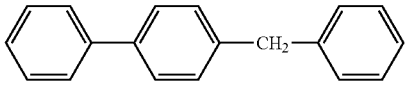

(BP-6)

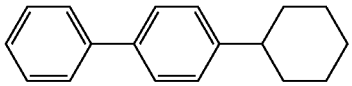

-continued (BP-7)

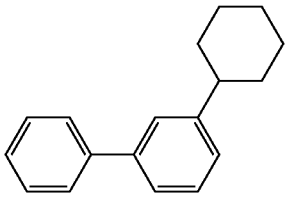

(BP-8)

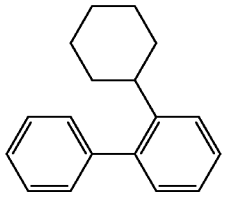

(BP-9)

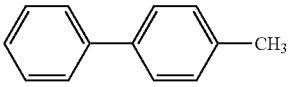

(BP-10)

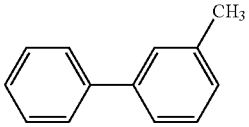

(BP-11)

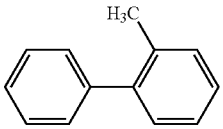

(BP-12)

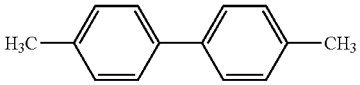

(BP-13)

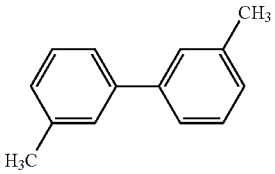

(BP-14)

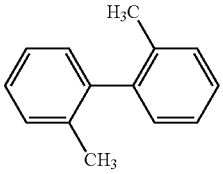

(BP-15)

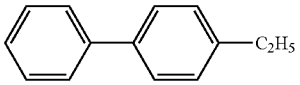

(BP-16)

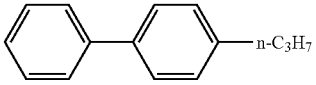

(BP-17)

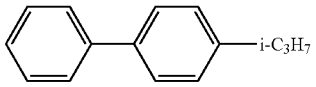

-continued (BP-18)

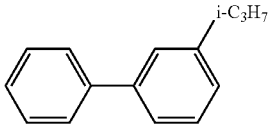

(BP-19)

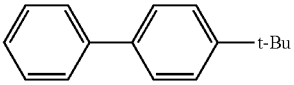

(BP-20)

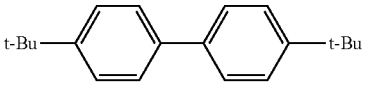

[Intermediate Layer (Undercoat Layer)]

The electrophotographic photosensitive member according to the present embodiment may include an undercoat layer as an intermediate layer. The undercoat layer is disposed between the conductive substrate and the charge generating layer and contains inorganic particles and a resin used for an undercoat layer (undercoat-layer resin). The presence of the undercoat layer between the conductive substrate and the charge generating layer can provide insulation to the extent of reducing leak current and still allows electric current to smoothly flow when the electrophotographic photosensitive member is exposed to light. This is effective to suppress increase in resistance.

Examples of the inorganic particles include particles of metals (aluminum, iron, and copper), metal oxides (titanium oxide, alumina, zirconium oxide, tin oxide, and zinc oxide), and non-metal oxides (silica), and the like. One type of these inorganic particles may be used alone, or two or more types of these inorganic particles may be used in combination.

The undercoat-layer resin is not particularly limited as long as it is usable for the undercoat layer. For example, from among the examples of the charge-generating-layer base resin listed in the description of the charge generating layer, one of the charge-generating-layer base resins may be used alone or two or more of the charge-generating-layer base resins may be used in combination.

[Method for Manufacturing Electrophotographic Photosensitive Member]

First, a description is given of a method for manufacturing the single-layer electrophotographic photosensitive member.

The single-layer electrophotographic photosensitive member is manufactured by applying an application liquid for a single-layer photosensitive layer (first application liquid) on a conductive substrate, followed by drying. The first application liquid is prepared by dissolving or dispersing in a solvent the charge generating material, the charge transport material (the hole transport material and the electron transport material), the binder resin, and one or more additives as needed.

The respective contents of the charge generating material, the charge transport material (the hole transport material and the electron transport material), and the binder resin in the single-layer electrophotographic photosensitive member can be appropriately determined and not particularly limited. Specifically, for example, the content of the charge generating material is preferably 0.1 parts by mass or more and 50 parts by mass or less with respect to 100 parts by mass of the binder resin, and more preferably 0.5 parts by mass or more and 30 parts by mass or less. In addition, the content of the electron transport material is preferably 5 parts by mass or more and 100 parts by mass or less with respect to 100 parts by mass of the binder resin, and more preferably 10 parts by mass or more and 80 parts by mass or less. In addition, the content of the hole transport material is preferably 5 parts by mass or more and 500 parts by mass or less with respect to 100 parts by mass of the binder resin, and more preferably 25 parts by mass or more and 200 parts by mass or less. In addition, the total content of the hole transport material and the electron transport material, or equivalently the content of the charge transport material is preferably 20 parts by mass or more and 500 parts by mass or less with respect to 100 parts by mass of the binder resin, and more preferably 30 parts by mass or more and 200 parts by mass or less.

The thickness of the single-layer photosensitive layer included in the single-layer electrophotographic photosensitive member is not particularly limited as long as the photosensitive layer can work sufficiently. More specifically, the thickness of the single-layer photosensitive layer is preferably 5 μm or more and 100 μm or less, and more preferably 10 μm or more and 50 μm or less.

Next, a description is given of a method for manufacturing the multi-layer electrophotographic photosensitive member.

Specifically, for example, an application liquid for the charge generating layer (second application liquid) and an application liquid for the charge transport layer (third application liquid) are prepared first. Then, either the second or third application liquid is applied to a conductive substrate, followed by drying to form a corresponding one of the charge generating layer and the charge transport layer. Subsequently, the other application liquid is applied to the charge generating layer or the charge transport layer formed on the conductive substrate, followed by drying. This forms the other one of the charge generating layer and the charge transport layer and thus completes the manufacture of the multi-layer electrophotographic photosensitive member.

The second application liquid is prepared by dissolving or dispersing in a solvent the charge generating material, the base resin, and one or more additives as needed. The third application liquid is prepared by dissolving or dispersing in a solvent the charge transport material, the binder resin, and one or more additives as needed.

The respective contents of the charge generating material, the charge transport material, the base resin, and the binder resin in the multi-layer electrophotographic photosensitive member can be appropriately determined and not particularly limited. More specifically, the content of the charge generating material is preferably 5 parts by mass or more and 1000 parts by mass or less with respect to 100 parts by mass of the base resin contained in the charge generating layer, and more preferably 30 parts by mass or more and 500 parts by mass or less.

In addition, the content of the charge transport material is preferably 10 parts by mass or more and 500 parts by mass or less with respect to 100 parts by mass of the binder resin contained in the charge transport layer, and more preferably 25 parts by mass or more and 100 parts by mass or less.

The thickness of each of the charge generating layer and the charge transport layer is not particularly limited as long as the respective layers can work sufficiently. Specifically, the thickness of the charge generating layer is preferably 0.01 μm or more and 5 μm or less, and more preferably 0.1 μm or more and 3 μm or less. In addition, the thickness of the charge transport layer is preferably 2 μm or more and 100 μm or less, and more preferably 5 μm or more and 50 μm or less.

The solvent contained in each application liquid (the first, second, or third application liquid) is not particularly limited as long as the respective components can be dissolved or dispersed therein. Specific examples of the solvent include alcohols (such as methanol, ethanol, isopropanol, and butanol), aliphatic hydrocarbons (such as n-hexane, octane, and cyclohexane), aromatic hydrocarbons (such as benzene, toluene, and xylene), halogenated hydrocarbons (such as dichloromethane, dichloroethane, carbon tetrachloride, and chlorobenzene), ethers (such as dimethyl ether, diethyl ether, tetrahydrofuran, ethylene glycol dimethyl ether, and diethylene glycol dimethyl ether), ketones (such as acetone, methyl ethyl ketone, and cyclohexane), esters (such as ethyl acetate, and methyl acetate), dimethyl formaldehyde, dimethyl formamide, and dimethyl sulfoxide. One of these solvents listed above as examples may be used alone or two or more of the solvents may be used in combination. From the standpoint of improving the safety and health of workers involved in the manufacturing of the photosensitive members, non-halogenated solvents are preferred as the solvent to be used.

Each application liquid for either the single- or multi-layer electrophotographic photosensitive member is prepared by mixing and dispersing the respective components in a solvent. The mixing or dispersing can be carried out using, for example, a bead mill, a roll mill, a ball mill, an attritor, a paint shaker, an ultrasonic disperser, and the like.

Each application liquid may additionally contain a surfactant or a leveling agent to improve the dispersibility of the respective components and the surface smoothness of the photosensitive layer.

The method for applying each application liquid is not particularly limited as long as the application liquid can be applied uniformly. Examples of the application method include dip coating, spray coating, spin coating, and bar coating.

The drying method is not particularly limited as long as the solvent in the application liquid is made to evaporate to form the respective layers. Examples of the drying method include a heat treatment (hot-air drying) by using a high-temperature dryer or a vacuum dryer. The heat treatment is carried out at 40° C. or more and 150° C. or less for 3 to 120 minutes.

The electrophotographic photosensitive member according to the present embodiment is usable as the image bearing member of an electrophotographic image forming apparatus. Note that the image forming apparatus is not particularly limited as long as the apparatus employs an electrophotographic method. In one specific example, the electrophotographic photosensitive member is usable as the image bearing member of the later-described image forming apparatus.

[Image Forming Apparatus]

An image forming apparatus according to the present embodiment includes an image bearing member, a charger, an exposure, a developer, and a transfer unit. The charger charges a surface of the image bearing member. The exposure exposes, to light, the surface of the image bearing member charged by the charger so as to form an electrostatic latent image on the surface of the image bearing member. The developer develops the electrostatic latent image into a toner image. The transfer unit transfers the toner image from the image bearing member to a transfer target. The image bearing member included in the image forming apparatus according to the present embodiment is the electrophotographic photosensitive member according to the present embodiment described above. That is to say, the image forming apparatus according to the present embodiment is not particularly limited and can be any electrophotographic image forming apparatus as long as the electrophotographic photosensitive member described above is used as its image bearing member.

The image forming apparatus according to the present embodiment preferably includes a contact charging type charger because such an image forming apparatus can reduce emission of gas, such as ozone.

In addition, a tandem-type color image forming apparatus that uses toners of a plurality of colors is applicable as the image forming apparatus according to the present embodiment. More specifically, the image forming apparatus includes a plurality of photosensitive members each as an image bearing member and also includes a plurality of developing devices each having a developing roller. The photosensitive members are for forming toner images of the respective colors on their surfaces and disposed in parallel in a predetermined direction. The developing rollers are disposed to face the respective photosensitive members and each carry toner on its surface to supply the toner to the surface of the corresponding photosensitive member.

Figure 3:
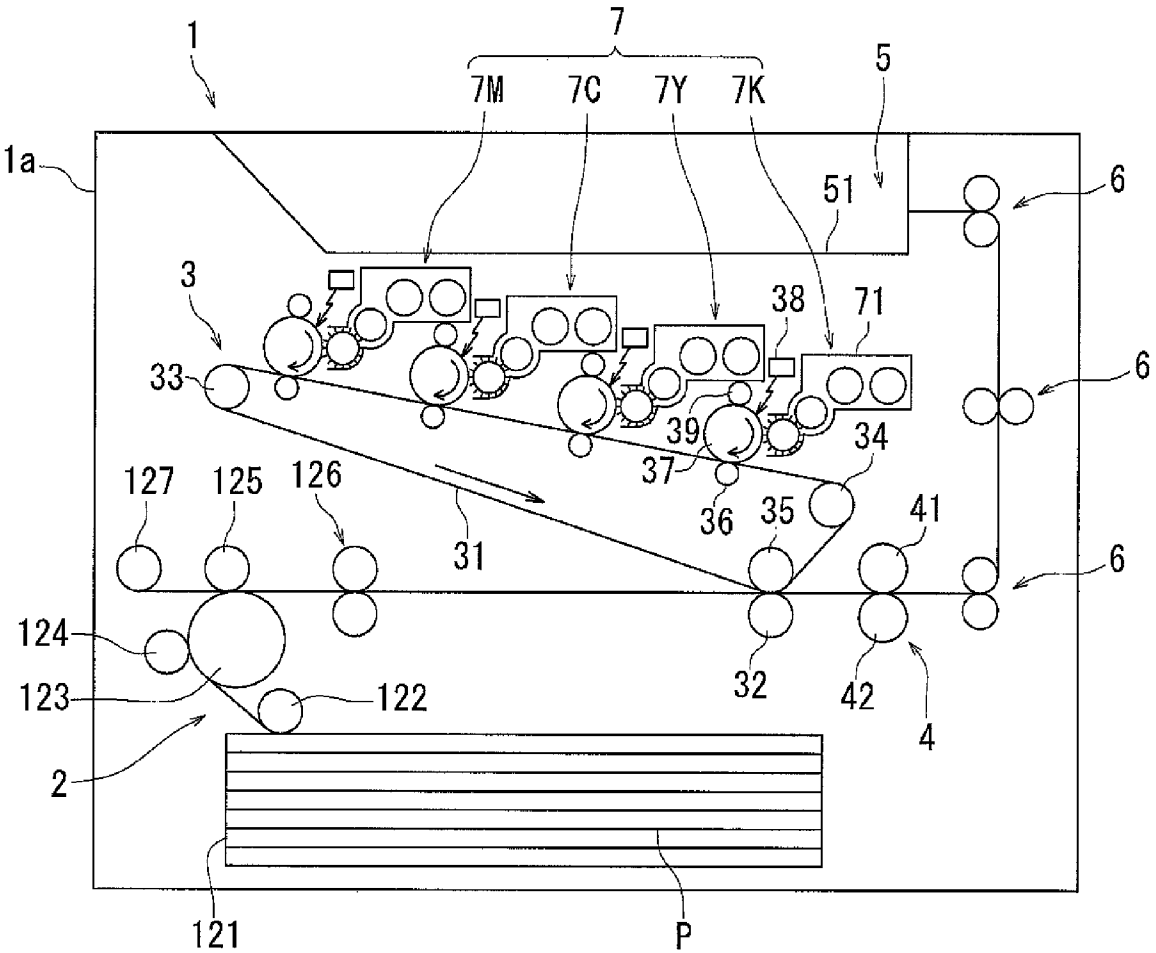
FIG. 3 is a schematic view showing a structure of an image forming apparatus that includes an electrophotographic photosensitive member according to the embodiment of the present disclosure.

The following describes a tandem-type color printer as an example of the image forming apparatus according to the present embodiment, with reference to FIG. 3.

FIG. 3 is a schematic view showing a structure of an image forming apparatus (color printer 1) according to the embodiment of the present disclosure. The color printer 1 includes the electrophotographic photosensitive members described above and includes a boxlike main body 1*a*. The boxlike main body 1*a* houses therein a paper feed section 2, an image forming section 3, and a fixing section 4. The paper feed section 2 feeds paper P. The image forming section 3 transfers a toner image conforming to image data or the like to paper P, while conveying the paper P fed from the paper feed section 2. The fixing section 4 is for performing a fixing process. More specifically, the fixing section 4 fixes an unfixed toner image, which has been transferred to the paper P by the image forming section 3, to the paper P. In addition, a paper ejecting section 5 is disposed on the upper surface of the main body 1*a*. The paper ejection section 5 receives the paper P ejected after being subjected to the fixing process by the fixing section 4.

The paper feed section 2 includes a paper feed cassette 121, a pickup roller 122, paper feed rollers 123, 124, and 125, and a pair of registration rollers 126. The paper feed cassette 121 is detachably disposed to the main body 1*a* and stores paper P of various sizes. The pickup roller 122 is disposed at a location above the paper feed cassette 121 and picks up the paper P stored in the paper feed cassette 121 sheet by sheet. The paper feed rollers 123, 124, and 125 feed the paper P picked up by the pickup roller 122 into a paper conveyance path. The pair of registration rollers 126 feeds the paper P which is fed into the paper conveyance path by the paper feed rollers 123, 124, and 125, to the image forming section 3 with a predetermined timing after temporarily holding the paper P in standby.

The paper feed section 2 additionally includes a manual feed tray (not shown) to be attached to the main body 1*a* and also includes a pickup roller 127 as shown in FIG. 3. The pickup roller 127 picks up the paper P placed on the manual feed tray. The paper P picked up by the pickup roller 127 is fed into the paper conveyance path by the paper feed rollers 123 and 125. The paper P is then fed to the image forming section 3 with a predetermined timing by the pair of registration rollers 126.

The image forming section 3 includes an image forming unit 7, an intermediate transfer belt 31, and a secondary transfer roller 32. In a primary transfer process, the image forming unit 7 transfers toner images conforming to image data transmitted from a computer or the like to a surface of the intermediate transfer belt 31 (the contact surface with the secondary transfer roller 32). Then, in a secondary transfer process, the secondary transfer roller 32 is used to transfer the toner images on the intermediate transfer belt 31 to the paper P fed from the paper feed cassette 121.

The image forming unit 7 includes a unit for black ink 7K, a unit for yellow ink 7Y, a unit for cyan ink 7C, and a unit for magenta ink 7M disposed in the stated order from the upstream side (from the right hand side in FIG. 3) to the downstream side. The respective units 7K, 7Y, 7C, and 7M each include, as the image bearing member, a photosensitive drum 37 disposed centrally of the corresponding unit to be rotatable in the arrowed direction (clockwise). Each photosensitive drum 37 is surrounded by a charger 39, an exposure device 38, a developing device 71, and a cleaning device (not shown), and a static eliminator (not shown) as a static eliminating section that are disposed in the stated order from the upstream side in the rotation direction. Note that each photosensitive drum 37 used herein is the electrophotographic photosensitive member according to the present embodiment described above.

Note that the charger 39 included in the image forming apparatus according to the present embodiment is a contact charging type charger. However, a non-contact charging type charger may be used as long as it can uniformly charges the peripheral surface of the corresponding photosensitive drum 37 being rotated in the arrowed direction. Examples of the contact charging type charger 39 include a charger that includes a contact type charging roller or charging brush (a device which charges the peripheral surface (surface) of the corresponding photosensitive drum 37 with the charging roller or charging brush that stays in contact with the photosensitive drum 37).

Examples of the contact type charging roller include a roller that is rotated by the rotation of the corresponding photosensitive drum 37 while staying in contact with the photosensitive drum 37. At least a surface portion of the charging roller is made from a resin. More specifically, the charging roller may include, for example, a core bar supported to be axially rotatable, a resin layer coating the core bar, and a voltage application section for applying voltage to the core bar. The charger provided with such a charging roller can apply voltage to the core bar by the voltage application section. Consequently, the charging roller can charge the surface of the corresponding photosensitive drum 37 that is in contact with the charging roller via the resin layer.

The charger having such a contact type charging roller is associated with the tendency that the abrasion amount of the topmost layer (the charge transport layer in the case of a multi-layer electrophotographic photosensitive member, and the single-layer photosensitive layer in the case of a single layer electrophotographic photosensitive member) is large in the case where organic electrophotographic photosensitive member is used as the image bearing member. Yet, on condition that the topmost layer of an electrophotographic photosensitive member is the charge transport layer, the electrophotographic photosensitive member can be used as the image bearing member to ensure that the abrasion amount of the topmost layer is small and the durability is high. In view of the above, the electrophotographic photosensitive member which can ensure a small abrasion amount and high durability can be obtained, without compromising the advantages of an organic photosensitive member, including easy manufacture, a wide variety of choices for an organic material of its photosensitive layer, and high design flexibility.

The resin forming the resin layer of the charging roller is not particularly limited. Examples of usable resins include a silicone resin, a urethane resin, and a silicone modified resin. The resin layer may contain inorganic filler.

Preferably, the voltage applied by the voltage application section is direct voltage only. By doing so, in the case where the image bearing member used is an electrophotographic photosensitive member of which the topmost layer is the charge transport layer (in the case of a multi-layer electrophotographic photosensitive member) or the single-layer photosensitive layer (in the case of a single-layer electrophotographic photosensitive member), the abrasion amount of the topmost layer can be reduced. More specifically, the abrasion amount of the topmost layer, which is either the charge transport layer or the single-layer photosensitive layer, can be made smaller when the voltage applied to the charging roller is limited to direct voltage than when alternating voltage or superimposed voltage in which direct voltage and alternating voltage are superimposed is applied.

It is likely that application of alternating voltage can make the potential of the charged surface (peripheral surface) of the image bearing member uniform. Yet, in the case of an image forming apparatus that includes a contact charging type charger, application of only direct voltage can still ensure uniform charging. Therefore, application of only direct voltage to the charging roller can ensure that appropriate images are formed while reducing the abrasion amount of the photosensitive layer.

Each exposure device 38 is a so-called a laser scanning unit. According to image data that is input from a personal computer (PC) being a higher-order device, the exposure device 38 scans a laser beam across the peripheral surface of the corresponding photosensitive drum 37 having been uniformly charged by the corresponding charger 39. As a result, an electrostatic latent image conforming to the image data is formed on the photosensitive drum 37. Each developing device 71 supplies toner to the peripheral surface of the corresponding photosensitive drum 37 having the electrostatic latent image formed thereon. As a result, a toner image conforming to the image data is formed. The respective toner images are then transferred to the intermediate transfer belt 31 in the primary transfer process. Each cleaning device cleans residual toner from the peripheral surface of the corresponding photosensitive drum 37 after the completion of the primary transfer process of the toner images to the intermediate transfer belt 31. Each static eliminator eliminates the charges on the peripheral surface of the corresponding photosensitive drum 37 after the completion of the primary transfer process. The peripheral surface of the photosensitive drum 37 subjected to the cleaning process by the cleaning device and the static eliminator moves toward the charger 39 to be newly subjected to a charging process for forming a new image.

The intermediate transfer belt 31 is a rotating body in the shape of an endless belt. The intermediate transfer belt 31 is wound around a plurality of rollers (namely, a drive roller 33, a driven roller 34, a backup roller 35, and a plurality of primary transfer rollers 36) such that the surface (contact surface) of the intermediate transfer belt 31 is in contact with the peripheral surface of the respective photosensitive drums 37. The intermediate transfer belt 31 is pressed against the photosensitive drums 37 by the respective primary transfer rollers 36 disposed to face the photosensitive drums 37. As the plurality of rollers rotate, the intermediate transfer belt 31 is rotated endlessly in the state pressed against the photosensitive drums 37. The drive roller 33 is driven to rotate by a drive source (a stepping motor, for example) to cause the intermediate transfer belt 31 to rotate endlessly. The driven roller 34, the backup roller 35, and the primary transfer rollers 36 are disposed to be freely rotatable and rotated by the endless rotation of the intermediate transfer belt 31 that is driven by the drive roller 33. The driven roller 34, the backup roller 35, and the primary transfer roller 36 are rotated by the active rotation of the drive roller 33 via the intermediate transfer belt 31 and also support the intermediate transfer belt 31.

The intermediate transfer belt 31 is driven by the drive roller 33 to rotate in the direction indicated by the arrow (counterclockwise) between each photosensitive member 37 and the corresponding primary transfer roller 36. Each primary transfer roller 36 applies primary transfer bias (of the opposite polarity to the charging polarity of toner) to the intermediate transfer belt 31. By doing so, the toner images formed on the respective photosensitive drums 37 are sequentially transferred (in the primary transfer process) to the intermediate transfer belt 31 to be superimposed thereon.

The secondary transfer roller 32 applies secondary transfer bias (of the opposite polarity to the charging polarity of toner images) to the paper P. By doing so, the toner images transferred to the intermediate transfer belt 31 in the primary transfer process are transferred to the paper P at a location between the secondary transfer roller 32 and the backup roller 35. As a result, an unfixed color toner image is transferred to the paper P.

The fixing section 4 performs a fixing process on the unfixed toner image transferred to the paper P by the image forming section 3. The fixing section 4 includes a heating roller 41 and a pressure roller 42. The heating roller 41 is heated by a conductive heating element. The pressure roller 42 is disposed to face the heating roller 41 such that the peripheral surface of the pressure roller 42 is pressed against the peripheral surface of the heating roller 41.

The images transferred to the paper P by the secondary transfer roller 32 of the image forming section 3 are fixed to the paper P through the fixing process of applying heat when the paper P passes between the heating roller 41 and the pressure roller 42. The paper P having been subjected to the fixing process is ejected to the paper ejection section 5. The image forming apparatus (color printer 1) according to the present embodiment also includes a plurality of conveyance rollers 6 at locations between the fixing section 4 and the paper ejection section 5.

The paper ejecting section 5 is a recess formed on the top of the main body 1*a* of the color printer 1. The paper ejecting section 5 is provided with an exit tray 51 for receiving paper P ejected toward the bottom of the recess.

The image forming apparatus (color printer 1) according to the present embodiment forms an image on the paper P through the image forming operation described above. Each image bearing member included in the image forming apparatus according to the present embodiment is the electrophotographic photosensitive member according to the present embodiment described above. Therefore, especially in the case where the contact charging type chargers are used, the abrasion amount of the charge transport layer or single-layer photosensitive layer is reduced significantly, which ensures that the image forming apparatus is capable of forming appropriate images over a long period without having to replace the image bearing members.

EXAMPLES

The following more specifically describes the present disclosure by way of examples. It should be noted that the present disclosure is in no way limited by the examples.

Manufacture of Multi-Layer Electrophotographic Photosensitive Member

Example 1

Formation of Undercoat Layer

First, titanium oxide having been subjected to a surface treatment (SMT-A (trial product) manufactured by Tayca Corporation, number-average primary particle size: 10 nm) was prepared. More specifically, the titanium oxide having been subjected to a surface treatment with alumina and silica, followed by a surface treatment with methyl hydrogen polysiloxane by wet dispersion was prepared. By using a bead mill, the thus prepared titanium oxide (2 parts by mass) was mixed with a four-component copolymer polyamide resin of polyamide 6, polyamide 12, polyamide 66, and polyamide 610 (Amilan (registered trademark) CM8000 manufactured by Toray Industries, Inc.) (one part by mass) into a mixed solvent containing methanol (10 parts by mass), butanol (one part by mass), and of toluene (one part by mass). The resulting mixture was dispersed for 5 hours to prepare an application liquid for an undercoat layer.

The thus prepared application liquid for an undercoat layer was filtered with a filter (opening: 5 μm). Then, the thus prepared application liquid for an undercoat layer was applied by dip coating to a conductive substrate, which was a drum-shaped support made of aluminum (diameter: 30 mm, and overall length: 246 mm) Subsequently, the application liquid thus applied was subjected to a heat treatment at 130° C. for 30 minutes to form an undercoat layer having a thickness of 1 μm.

(Formation of Charge Generating Layer)

Next, the second application liquid was prepared by mixing the following components for two hours by using a bead mill to disperse the respective components: CGM-2 (1.5 parts by mass); a polyvinyl acetal resin (1 part by mass) (S-LEC BX-5 manufactured by SEKISUI CHEMICAL CO., LTD.) as the base resin; and propylene glycol monomethyl ether (40 parts by mass) and tetrahydrofuran (40 parts by mass) both as a solvent. The thus prepared application liquid was filtered with a filter (opening: 3 μm), and then applied by dip coating to the undercoat layer formed in the above-described manner, followed by drying at 50° C. for ten minutes. As a result, a charge generating layer having a thickness of 0.3 μm was formed.

(Formation of Charge Transport Layer)

Next, the third application liquid was prepared by mixing and dissolving: HTM-1 (45 parts by mass), which is the above-described amine stilbene derivative as the hole transport material; dibutylhydroxytoluene (0.5 parts by mass) and meta-terphenyl (3 parts by mass) both as an additive; ETM-1 (1 part by mass) as the electron transport material; a polycarbonate resin (100 parts by mass) (Resin-1, viscosity average molecular weight: 50,100) as the binder resin; and tetrahydrofuran (420 parts by mass) and toluene (210 parts by mass) both as a solvent. The composition of Resin-1 is represented by the chemical formula (21) below. Note that the numerical subscripts appearing in the chemical formula (21) as well as in the later-described chemical formulas (22) to (27) represent the rate of the respective constitutional repeating units appearing in the polycarbonate resin.

Resin-1

(21)

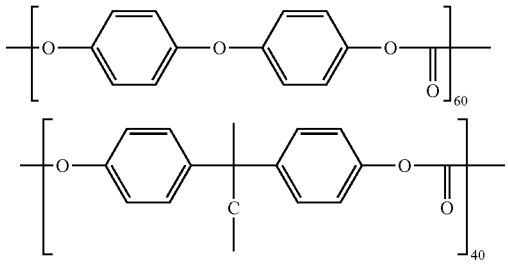

The third application liquid thus prepared was applied to the charge generating layer in manner similar to the application of the second application liquid. Subsequently, the third application liquid thus applied was dried at 120° C. for 40 minutes to form a charge transport layer having a thickness of 20 μm. This completed the manufacture of the multi-layer electrophotographic photosensitive member.

Example 2

A multi-layer electrophotographic photosensitive member of Example 2 was prepared in the same manner as Example 1, except for that the hole transport material used was HTM-2 instead of HTM-1.

Example 3

A multi-layer electrophotographic photosensitive member of Example 3 was prepared in the same manner as Example 1, except for that the hole transport material used was HTM-3 instead of HTM-1.

Example 4

A multi-layer electrophotographic photosensitive member of Example 4 was prepared in the same manner as Example 1, except for that the hole transport material used was HTM-4 instead of HTM-1.

Example 5

A multi-layer electrophotographic photosensitive member of Example 5 was prepared in the same manner as Example 1, except for that the hole transport material used was HTM-5 instead of HTM-1.

Example 6

A multi-layer electrophotographic photosensitive member of Example 6 was prepared in the same manner as Example 1, except for that the hole transport material used was HTM-6 instead of HTM-1.

Example 7

A multi-layer electrophotographic photosensitive member of Example 7 was prepared in the same manner as Example 1, except for that the binder resin used was Resin-2 (viscosity average molecular weight: 50,000) instead of Resin-1. The composition of Resin-2 is represented by the chemical formula (22) below.

Resin-2

(22)

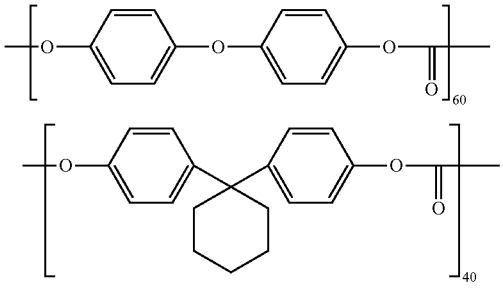

Example 8

A multi-layer electrophotographic photosensitive member of Example 8 was prepared in the same manner as Example 1, except for that the binder resin used was Resin-3 (viscosity average molecular weight: 50,300) instead of Resin-1. The composition of Resin-3 is represented by the chemical formula (23) below.

Resin-3

(23)

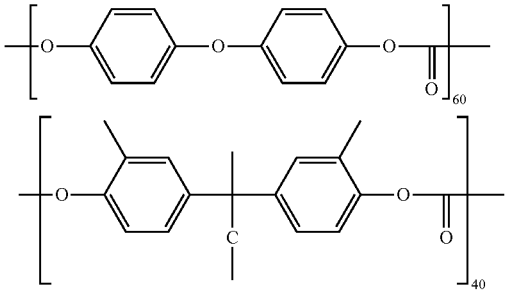

Example 9

A multi-layer electrophotographic photosensitive member of Example 9 was prepared in the same manner as Example 1, except for that the binder resin used was Resin-4 (viscosity average molecular weight: 50,200) instead of Resin-1. The composition of Resin-4 is represented by the chemical formula (24) below.

Resin-4

(24)

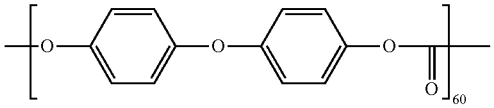

-continued

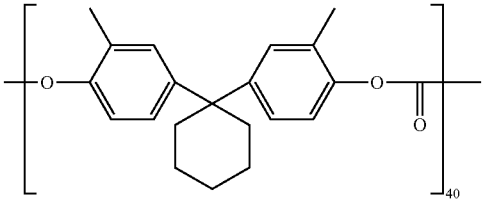

Example 10

A multi-layer electrophotographic photosensitive member of Example 10 was prepared in the same manner as Example 1, except for that the binder resin used was Resin-5 (viscosity average molecular weight: 50,000) instead of Resin-1. The composition of Resin-5 is represented by the chemical formula (25) below.

Resin-5

(25)

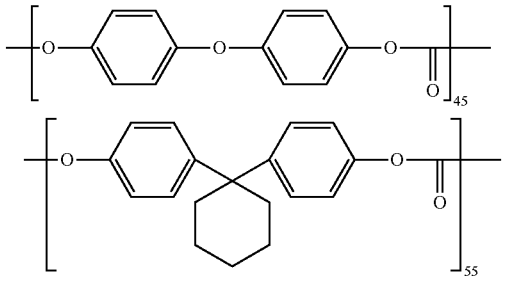

Comparative Example 1

A multi-layer electrophotographic photosensitive member of Comparative Example 1 was prepared in the same manner as Example 1, except for that the binder resin used was Resin-6 (viscosity average molecular weight: 50,100) instead of Resin-1. The composition of Resin-6 is represented by the chemical formula (26) below.

Resin-6

(26)

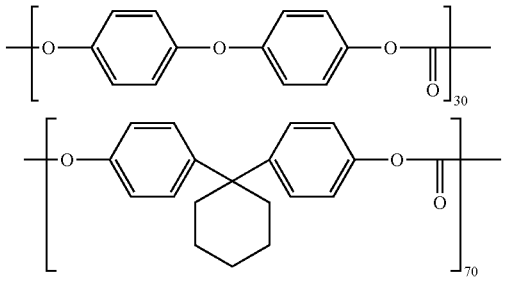

Comparative Example 2

A multi-layer electrophotographic photosensitive member of Comparative Example 2 was prepared in the same manner as Example 1, except for that the binder resin used was Resin-7 (viscosity average molecular weight: 50,100) instead of Resin-1. The composition of Resin-7 is represented by the chemical formula (27) below.

Resin-7

(27)

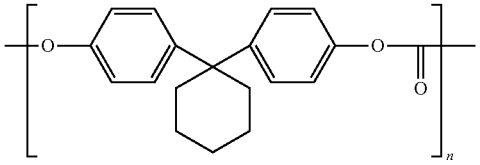

Comparative Example 3

A multi-layer electrophotographic photosensitive member of Comparative Example 3 was prepared in the same manner as Comparative Example 2, except for that the hole transport material used was HTM-2 instead of HTM-1.

Comparative Example 4

A multi-layer electrophotographic photosensitive member of Comparative Example 4 was prepared in the same manner as Comparative Example 2, except for that the hole transport material used was HTM-3 instead of HTM-1.

Comparative Example 5

A multi-layer electrophotographic photosensitive member of Comparative Example 5 was prepared in the same manner as Comparative Example 2, except for that the hole transport material used was HTM-4 instead of HTM-1.

Comparative Example 6

A multi-layer electrophotographic photosensitive member of Comparative Example 6 was prepared in the same manner as Comparative Example 2, except for that the hole transport material used was HTM-5 instead of HTM-1.

Comparative Example 7

A multi-layer electrophotographic photosensitive member of Comparative Example 7 was prepared in the same manner as Comparative Example 2, except for that the hole transport material used was HTM-6 instead of HTM-1.

[Manufacture of Single-Layer Electrophotographic Photosensitive Member]

Example 11

The following were added into a solvent of tetrahydrofuran (800 parts by mass): HTM-1 (50 parts by mass), which is the amine stilbene derivative as the hole transport material; ETM-2 (20 parts by mass) as the electron transport material; CGM-1 (3 parts by mass), which is X-form metal-free phthalocyanine as the charge generating material; and Resin-1 (100 parts by mass), which is a polycarbonate resin as the binder resin. Subsequently, the resulting mixture was mixed to disperse the respective components in the solvent by using an ultrasonic disperser to prepare the first application liquid for the single-layer electrophotographic photosensitive member. The application liquid thus prepared was applied to a conductive substrate (aluminum element tube). The application liquid thus applied to the conductive substrate was subjected to hot-air drying at 100° C. for 30 minutes. As a result, a single-layer electrophotographic photosensitive member having a thickness of 25 μm was obtained as Example 11.

Example 12

A single-layer electrophotographic photosensitive member of Example 12 was prepared in the same manner as Example 11, except for that the hole transport material used was HTM-2 instead of HTM-1.

Example 13

A single-layer electrophotographic photosensitive member of Example 13 was prepared in the same manner as Example 11, except for that the hole transport material used was HTM-3 instead of HTM-1.

Example 14

A single-layer electrophotographic photosensitive member of Example 14 was prepared in the same manner as Example 11, except for that the hole transport material used was HTM-4 instead of HTM-1.

Example 15

A single-layer electrophotographic photosensitive member of Example 15 was prepared in the same manner as Example 11, except for that the hole transport material used was HTM-5 instead of HTM-1.

Example 16

A single-layer electrophotographic photosensitive member of Example 16 was prepared in the same manner as Example 11, except for that the hole transport material used was HTM-6 instead of HTM-1.

Example 17

A single-layer electrophotographic photosensitive member of Example 17 was prepared in the same manner as Example 11, except for that the binder resin used was Resin-2 (viscosity average molecular weight: 50,000) instead of Resin-1.

Example 18

A single-layer electrophotographic photosensitive member of Example 18 was prepared in the same manner as Example 11, except for that the binder resin used was Resin-3 (viscosity average molecular weight: 50,300) instead of Resin-1.

Example 19

A single-layer electrophotographic photosensitive member of Example 19 was prepared in the same manner as Example 11, except for that the binder resin used was Resin-4 (viscosity average molecular weight: 50,200) instead of Resin-1.

Example 20

A single-layer electrophotographic photosensitive member of Example 20 was prepared in the same manner as Example 11, except for that the binder resin used was Resin-5 (viscosity average molecular weight: 50,000) instead of Resin-1.

Example 21

A single-layer electrophotographic photosensitive member of Example 21 was prepared in the same manner as Example 11, except for that the charge generating material used was not CGM-1. Instead of CGM-1, CGM-2 (the same parts by mass as CGM-1) and PY-128 (1 part by mass) represented by the chemical formula (28) below were used as the charge generating material.

Example 28

A single-layer electrophotographic photosensitive member of Example 28 was prepared in the same manner as Example 21, except for that the electron transport material used was ETM-4 instead of ETM-2.

Example 29

A single-layer electrophotographic photosensitive member of Example 29 was prepared in the same manner as Example 21, except for that the electron transport material used was ETM-5 instead of ETM-2.

(28)

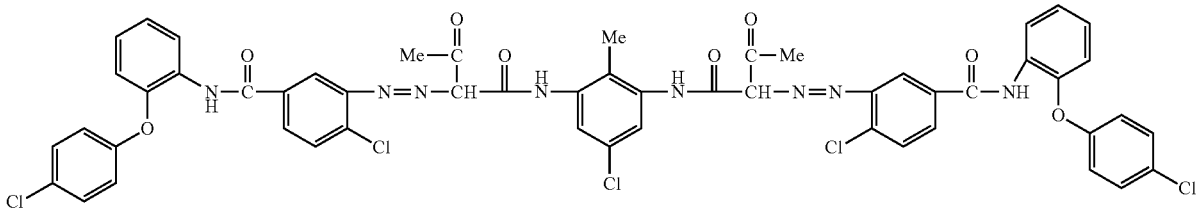

Example 22

A single-layer electrophotographic photosensitive member of Example 22 was prepared in the same manner as Example 21, except for that the hole transport material used was HTM-2 instead of HTM-1.

Example 23

A single-layer electrophotographic photosensitive member of Example 23 was prepared in the same manner as Example 21, except for that the hole transport material used was HTM-3 instead of HTM-1.

Example 24

A single-layer electrophotographic photosensitive member of Example 24 was prepared in the same manner as Example 21, except for that the hole transport material used was HTM-4 instead of HTM-1.

Example 25

A single-layer electrophotographic photosensitive member of Example 25 was prepared in the same manner as Example 21, except for that the hole transport material used was HTM-5 instead of HTM-1.

Example 26

A single-layer electrophotographic photosensitive member of Example 26 was prepared in the same manner as Example 21, except for that the hole transport material used was HTM-6 instead of HTM-1

Example 27

A single-layer electrophotographic photosensitive member of Example 27 was prepared in the same manner as Example 21, except for that the electron transport material used was ETM-3 instead of ETM-2.

Example 30

A single-layer electrophotographic photosensitive member of Example 30 was prepared in the same manner as Example 21, except for that the electron transport material used was ETM-6 instead of ETM-2.

Example 31

A single-layer electrophotographic photosensitive member of Example 31 was prepared in the same manner as Example 21, except for that the electron transport material used was ETM-7 instead of ETM-2.

Example 32

A single-layer electrophotographic photosensitive member of Example 32 was prepared in the same manner as Example 21, except for that the electron transport material used was ETM-8 instead of ETM-2.

Comparative Example 8

A single-layer electrophotographic photosensitive member of Comparative Example 8 was prepared in the same manner as Example 11, except for that the binder resin used was Resin-6 (viscosity average molecular weight: 50,100) instead of Resin-1.

Comparative Example 9

A single-layer electrophotographic photosensitive member of Comparative Example 9 was prepared in the same manner as Comparative Example 8, except for that the binder resin used was Resin-7 (viscosity average molecular weight: 50,100) instead of Resin-6.

Comparative Example 10

A single-layer electrophotographic photosensitive member of Comparative Example 10 was prepared in the same manner as Comparative Example 9, except for that the hole transport material used was HTM-2 instead of HTM-1.

Comparative Example 11

A single-layer electrophotographic photosensitive member of Comparative Example 11 was prepared in the same manner as Comparative Example 9, except for that the hole transport material used was HTM-3 instead of HTM-1.

Comparative Example 12

A single-layer electrophotographic photosensitive member of Comparative Example 12 was prepared in the same manner as Comparative Example 9, except for that the hole transport material used was HTM-4 instead of HTM-1.

Comparative Example 13

A single-layer electrophotographic photosensitive member of Comparative Example 13 was prepared in the same manner as Comparative Example 9, except for that the hole transport material used was HTM-5 instead of HTM-1.

Comparative Example 14

A single-layer electrophotographic photosensitive member of Comparative Example 14 was prepared in the same manner as Comparative Example 9, except for that the hole transport material used was HTM-6 instead of HTM-1.

[Performance Evaluation of Electrophotographic Photosensitive Members]

(Evaluation of Electrical Characteristics)

Each of the multi-layer electrophotographic photosensitive members prepared as Examples 1 to 10 and Comparative Examples 1 to 7 and of the single-layer electrophotographic photosensitive members prepared as Examples 11 to 32 and Comparative Examples 8 to 14 was measured for its charge ability (surface potential $V_0$) and sensitivity (residual potential $V_L$) by using an electrical characteristic check machine under the following conditions. In the measurement environment, the temperature was 10° C. and the humidity was 20% RH.

(Measurement Conditions for Multi-Layer Electrophotographic Photosensitive Members)

Each of the multi-layer electrophotographic photosensitive members prepared as Examples 1 to 10 and Comparative Examples 1 to 7 was charged to −600 V while being rotated at 31 rpm by using a drum sensitivity test device. In this state, the potential was measured and determined as the initial surface potential ($V_0$). Next, the surface of the multi-layer electrophotographic photosensitive member was irradiated with monochromatic light (wavelength: 780 nm, half-width: 20 nm, and light quantity: 0.26 μJ/cm$^2$) which was extracted by passing light emitted from the halogen lamp through a bandpass filter. The surface potential was measured after a lapse of 50 msec from the irradiation by the monochromatic light and determined as the residual potential ($V_L$).

(Measurement Conditions for Single-Layer Electrophotographic Photosensitive Members)

Each of the single-layer electrophotographic photosensitive members prepared as Examples 11 to 32 and Comparative Examples 8 to 14 was charged to 700 V by using a drum sensitivity test device. In this state, the potential was measured and determined as the initial surface potential ($V_0$). Next, the surface of the single-layer electrophotographic photosensitive member was irradiated with monochromatic light (wavelength: 780 nm, half-width: 20 nm, and light quantity: 1.5 μJ/cm$^2$) which was extracted by passing light emitted from the halogen lamp through a bandpass filter. The surface potential was measured after a lapse of 100 msec from the irradiation by the monochromatic light and determined as the residual potential ($V_L$).

[Abrasion Evaluation Test]

(Common Test for Single- and Multi-Layer Electrophotographic Photosensitive Members)

The third and first application liquids prepared as above were each applied to a polypropylene sheet (thickness: 0.3 mm) which was wound around an aluminum pipe (diameter: 78 mm) The respective application liquid as applied were dried at 120° C. for 40 minutes to prepare the abrasion evaluation test film sheets (thickness: 30 μm) each with a corresponding one of the charge transport layer of a multi-layer electrophotographic photosensitive member and the single-layer photosensitive layer of a single-layer electrophotographic photosensitive member formed thereon.

From each polypropylene sheet, the charge transport layer or single-layer photosensitive layer of the test film sheet was peeled away and applied to a wheel (S-36 manufactured by TABER Industries). In this way, the respective samples of the test film sheets were prepared. Each sample thus prepared was subjected to an abrasion evaluation test by using a rotary ablation tester (manufactured by Toyo Seiki Seisaku-sho, Ltd.), with an abrading wheel (CS-10 manufactured by TABER Industries), the load of 500 gf, and by rotating the sample 1000 times at 60 rpm. The abrasion loss (mg/1000 rotations), which is a difference in mass of the sample before and after the abrasion evaluation test, was measured to evaluate the abrasion resistance based on the abrasion loss.

Table 1 shows the results of the electrical characteristics evaluation and the abrasion evaluation test on the respective multi-layer electrophotographic photosensitive members prepared as Examples 1 to 10 and Comparative Examples 1 to 7, along with the materials contained in the charge transport layers of the respective multi-layer electrophotographic photosensitive members. Table 2 shows the results of the electrical characteristic evaluation test and the abrasion evaluation on the respective single-layer electrophotographic photosensitive members prepared as Examples 11 to 32 and Comparative Examples 8 to 14, along with the materials contained in the single-layer photosensitive layers of the respective single-layer electrophotographic photosensitive members.

TABLE 1

| | | Charge Transport Layer | | | Electrical Characteristics | | Abrasion Loss/mg (per 1000 |
|---|---|---|---|---|---|---|---|
| | | HTM | Resin | ETM | $V_O$/V | $V_L$/V | rotations) |
| Example | 1 | HTM-1 | Resin-1 | ETM-1 | −702 | −57 | 4.0 mg |
| | 2 | HTM-2 | Resin-1 | ETM-1 | −658 | −60 | 4.5 mg |
| | 3 | HTM-3 | Resin-1 | ETM-1 | −754 | −56 | 4.3 mg |
| | 4 | HTM-4 | Resin-1 | ETM-1 | −721 | −50 | 3.9 mg |
| | 5 | HTM-5 | Resin-1 | ETM-1 | −701 | −70 | 5.0 mg |
| | 6 | HTM-6 | Resin-1 | ETM-1 | −698 | −71 | 4.5 mg |
| | 7 | HTM-1 | Resin-2 | ETM-1 | −687 | −55 | 5.0 mg |
| | 8 | HTM-1 | Resin-3 | ETM-1 | −668 | −59 | 4.3 mg |
| | 9 | HTM-1 | Resin-4 | ETM-1 | −689 | −56 | 5.6 mg |
| | 10 | HTM-1 | Resin-5 | ETM-1 | −685 | −55 | 5.2 mg |
| Comparative Example | 1 | HTM-1 | Resin-6 | ETM-1 | −691 | −72 | 7.0 mg |
| | 2 | HTM-1 | Resin-7 | ETM-1 | −699 | −75 | 7.2 mg |
| | 3 | HTM-2 | Resin-7 | ETM-1 | −698 | −77 | 6.8 mg |

TABLE 1-continued

| | Charge Transport Layer | | | Electrical Characteristics | | Abrasion Loss/mg (per 1000 |
|---|---|---|---|---|---|---|
| | HTM | Resin | ETM | $V_O$/V | $V_L$/V | rotations) |
| 4 | HTM-3 | Resin-7 | ETM-1 | −712 | −80 | 8.1 mg |
| 5 | HTM-4 | Resin-7 | ETM-1 | −709 | −76 | 6.4 mg |
| 6 | HTM-5 | Resin-7 | ETM-1 | −735 | −91 | 7.7 mg |
| 7 | HTM-6 | Resin-7 | ETM-1 | −702 | −89 | 7.0 mg |

TABLE 2

| | | Single-Layer Photosensitive Layer | | | | Electrical Characteristics | Abrasion Loss/mg (per 1000 |
|---|---|---|---|---|---|---|---|
| | | CGM | HTM | Resin | ETM | $V_L$/V | rotations) |
| Example | 11 | CGM-1 | HTM-1 | Resin-1 | ETM-2 | 80 | 6.2 mg |
| | 12 | CGM-1 | HTM-2 | Resin-1 | ETM-2 | 84 | 6.4 mg |
| | 13 | CGM-1 | HTM-3 | Resin-1 | ETM-2 | 90 | 6.5 mg |
| | 14 | CGM-1 | HTM-4 | Resin-1 | ETM-2 | 78 | 6.3 mg |
| | 15 | CGM-1 | HTM-5 | Resin-1 | ETM-2 | 90 | 5.9 mg |
| | 16 | CGM-1 | HTM-6 | Resin-1 | ETM-2 | 94 | 6.9 mg |
| | 17 | CGM-1 | HTM-1 | Resin-2 | ETM-2 | 79 | 7.0 mg |
| | 18 | CGM-1 | HTM-1 | Resin-3 | ETM-2 | 80 | 6.2 mg |
| | 19 | CGM-1 | HTM-1 | Resin-4 | ETM-2 | 85 | 7.0 mg |
| | 20 | CGM-1 | HTM-1 | Resin-5 | ETM-2 | 78 | 7.3 mg |
| | 21 | CGM-2 + PY128 1 part by mass | HTM-1 | Resin-1 | ETM-2 | 65 | 6.3 mg |
| | 22 | CGM-2 + PY128 1 part by mass | HTM-2 | Resin-1 | ETM-2 | 65 | 6.7 mg |
| | 23 | CGM-2 + PY128 1 part by mass | HTM-3 | Resin-1 | ETM-2 | 60 | 5.4 mg |
| | 24 | CGM-2 + PY128 1 part by mass | HTM-4 | Resin-1 | ETM-2 | 67 | 6.9 mg |
| | 25 | CGM-2 + PY128 1 part by mass | HTM-5 | Resin-1 | ETM-2 | 69 | 5.8 mg |
| | 26 | CGM-2 + PY128 1 part by mass | HTM-6 | Resin-1 | ETM-2 | 72 | 5.6 mg |
| | 27 | CGM-2 + PY128 1 part by mass | HTM-1 | Resin-1 | ETM-3 | 73 | 6.4 mg |
| | 28 | CGM-2 + PY128 1 part by mass | HTM-1 | Resin-1 | ETM-4 | 65 | 6.5 mg |
| | 29 | CGM-2 + PY128 1 part by mass | HTM-1 | Resin-1 | ETM-5 | 64 | 7.0 mg |
| | 30 | CGM-2 + PY128 1 part by mass | HTM-1 | Resin-1 | ETM-6 | 60 | 6.4 mg |
| | 31 | CGM-2 + PY128 1 part by mass | HTM-1 | Resin-1 | ETM-7 | 55 | 5.5 mg |
| | 32 | CGM-2 + PY128 1 part by mass | HTM-1 | Resin-1 | ETM-8 | 75 | 7.6 mg |
| Comparative Example | 8 | CGM-1 | HTM-1 | Resin-6 | ETM-2 | 89 | 9.8 mg |
| | 9 | CGM-1 | HTM-1 | Resin-7 | ETM-2 | 92 | 10.2 mg |
| | 10 | CGM-1 | HTM-2 | Resin-7 | ETM-2 | 95 | 9.5 mg |
| | 11 | CGM-1 | HTM-3 | Resin-7 | ETM-2 | 90 | 9.3 mg |
| | 12 | CGM-1 | HTM-4 | Resin-7 | ETM-2 | 95 | 11.2 mg |
| | 13 | CGM-1 | HTM-5 | Resin-7 | ETM-2 | 98 | 9.9 mg |
| | 14 | CGM-1 | HTM-6 | Resin-7 | ETM-2 | 99 | 9.0 mg |

Each of the multi-layer electrophotographic photosensitive members (Examples 1 to 10) and the single-layer electrophotographic photosensitive members (Examples 11 to 32) according to the present disclosure contained the amine stilbene derivative represented by the general formula (1) as the charge transport material (hole transport material) and also contained the polycarbonate resin represented by the general formula (2) as the binder resin. As is clear from Tables 1 and 2, the multi- and single-layer electrophotographic photosensitive members according to the present disclosure exhibited a low residual potential in the evaluation of the electrical characteristics and a small abrasion loss in the abrasion evaluation test. Therefore, the multi- and single-layer electrophotographic photosensitive members according to the present disclosure can ensure to maintain excellent electrical characteristics while improving the abrasion resistance.

What is claimed is:

1. An electrophotographic photosensitive member comprising:

a photosensitive layer, wherein the photosensitive layer is either a single-layer photosensitive layer containing a charge generating material, a hole transport material, and a binder resin, or a multi-layer photosensitive layer in which a charge generating layer containing the charge generating material and a charge transport layer containing the hole transport material and the binder resin are stacked, the hole transport material contains an amine stilbene derivative HTM-5 represented by a chemical formula (11) or an amine stilbene derivative HTM-6 represented by a chemical formula (12), the charge generating material contains PY-128 represented by a chemical formula (28), and the binder resin contains a polycarbonate resin represented by a general formula (2), (11)

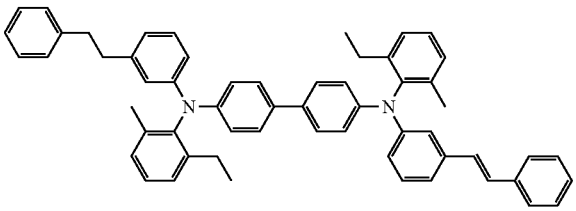

HTM-5

(12)

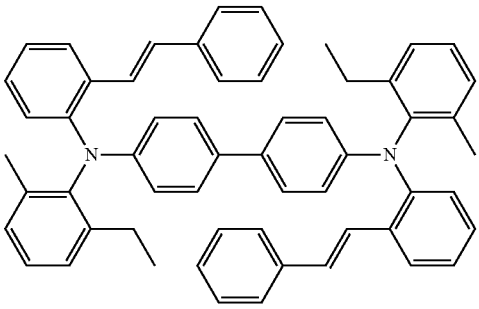

HTM-6

(28)

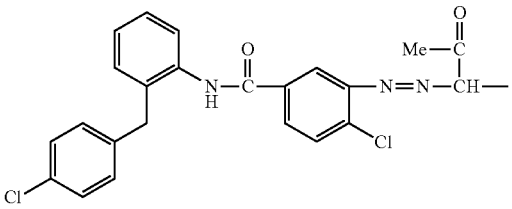

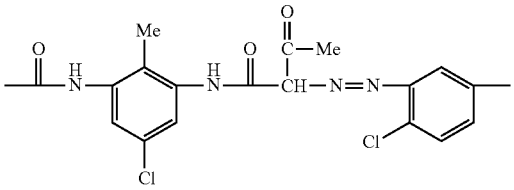

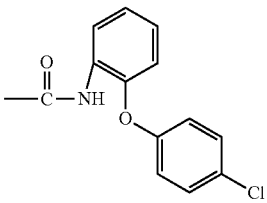

(2)

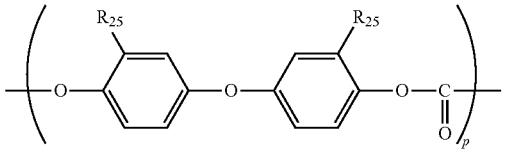

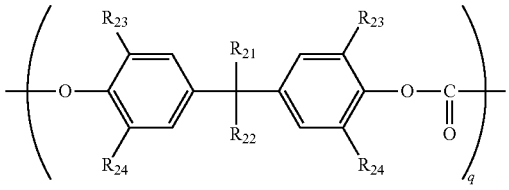

in the general formula (2), $R_{21}$ and $R_{22}$ each represent a hydrogen atom, an alkyl group having 1 to 8 carbon atoms, or a phenyl group, or $R_{21}$ and $R_{22}$ are bonded together to form a cycloalkylidene group having 5 to 8 carbon atoms, $R_{23}$ to $R_{25}$ each independently represent a hydrogen atom or an alkyl group having 1 to 4 carbon atoms, and $p+q=1$ and $p \geq 0.4$ are both satisfied.

2. An electrophotographic photosensitive member according to claim 1, wherein in the general formula (2), $R_{21}$ represents an ethyl group, and $R_{22}$ represents a methyl group.

3. An electrophotographic photosensitive member according to claim 1, wherein the binder resin has a viscosity average molecular weight of 30,000 or more.

4. An electrophotographic photosensitive member according to claim 1, wherein the single-layer photosensitive layer contains an electron transport material.

5. An image forming apparatus comprising:

an image bearing member;

a charger configured to charge a surface of the image bearing member;

an exposure configured to expose the surface of the image bearing member charged by the charger to light so as to form an electrostatic latent image on the surface;

a developer configured to develop the electrostatic latent image into a toner image; and a transfer unit configured to transfer the toner image from the image bearing member to a transfer target, wherein the image bearing member is an electrophotographic photosensitive member according to claim 1.

6. An electrophotographic photosensitive member according to claim 1, wherein the photosensitive layer is the multi-layer photosensitive layer, and the charge transport material contains at least one of ETM-1 to ETM-8 respectively represented by chemical formulas (13) to (20)

(13)
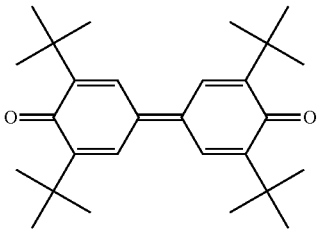
ETM-1
(14)
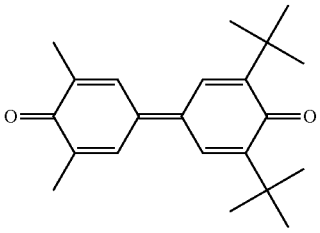
ETM-2
(15)
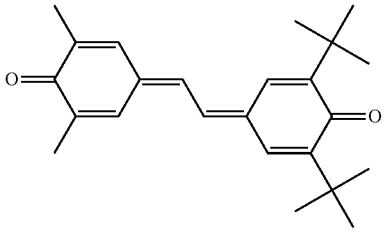
ETM-3
(16)
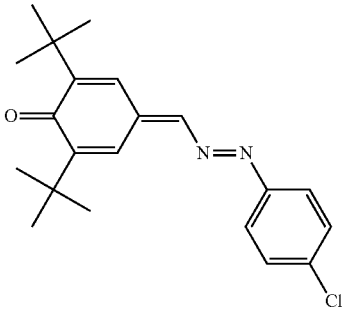
ETM-4
-continued
(17)
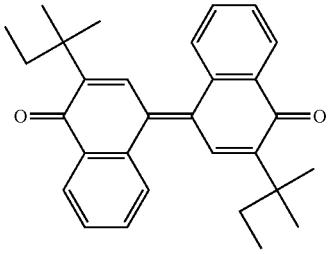
ETM-5
(18)
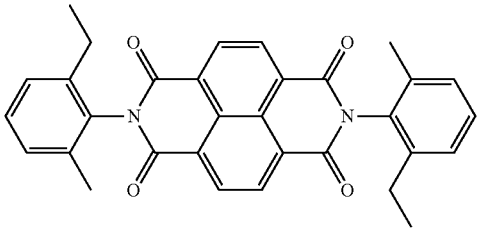
ETM-6
(19)
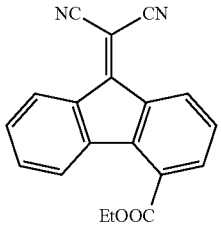
ETM-7
(20)
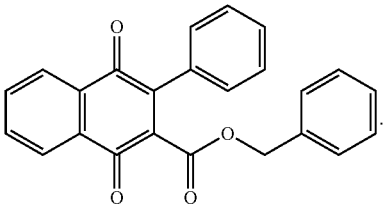
ETM-8
* * * * *